US011717938B2

(12) United States Patent
Nakamura et al.

(10) Patent No.: US 11,717,938 B2
(45) Date of Patent: Aug. 8, 2023

(54) ELECTRIC POWER TOOL

(71) Applicant: MAKITA CORPORATION, Anjo (JP)

(72) Inventors: Shin Nakamura, Anjo (JP); Hideharu Muto, Anjo (JP); Kenichi Tabushi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 981 days.

(21) Appl. No.: 16/270,037

(22) Filed: Feb. 7, 2019

(65) Prior Publication Data

US 2019/0262972 A1 Aug. 29, 2019

(30) Foreign Application Priority Data

Feb. 23, 2018 (JP) ..... 2018-031295

(51) Int. Cl.
*B24B 55/05* (2006.01)
*B24B 47/12* (2006.01)
*B24B 23/02* (2006.01)

(52) U.S. Cl.
CPC ..... *B24B 55/052* (2013.01); *B24B 23/022* (2013.01); *B24B 23/028* (2013.01); *B24B 47/12* (2013.01)

(58) Field of Classification Search
CPC ..... B24B 55/04; B24B 55/05; B24B 55/052; B24B 55/06; B24B 55/10; B24B 55/102; B24B 23/005; B24B 23/02; B24B 23/022; B24B 23/028; B24B 47/12; B24B 47/26; B24B 47/28; B24B 45/00; B24B 45/003; B24B 45/006; B25B 21/007; B25B 21/00; B25B 23/00; A01G 3/062
USPC ..... 81/57.11, 57.12, 57.13
See application file for complete search history.

(56) References Cited

U.S. PATENT DOCUMENTS 9,475,172 B2 * 10/2016 Cooksey ..... B24B 23/028
2009/0029635 A1 * 1/2009 Boeck ..... B24B 23/02 451/455
2011/0195643 A1 8/2011 Dai
2012/0037392 A1 2/2012 Ikuta et al.
(Continued)

FOREIGN PATENT DOCUMENTS

CN 102470503 A 5/2012
CN 103025488 A 4/2013
(Continued)

OTHER PUBLICATIONS

Aug. 3, 2021 Office Action issued in Japanese Patent Application No. 2018-031295.
(Continued)

*Primary Examiner* — Orlando E Aviles
*Assistant Examiner* — Sidney D Hohl
(74) *Attorney, Agent, or Firm* — Oliff PLC

(57) ABSTRACT

An electric power tool disclosed herein may include a motor; a power transmission mechanism connected to the motor; a housing that houses the motor and the power transmission mechanism; a tool holder projecting from the housing; a cover covering at least a part of a tool attached to the tool holder; and a mask member. The cover may include an engaging portion that engages with the housing. The mask member may have a shape that blocks visibility of at least a part of the engaging portion.

19 Claims, 22 Drawing Sheets

(56) References Cited

U.S. PATENT DOCUMENTS

| | | | | |
|---|---|---|---|---|
| 2012/0190280 | A1* | 7/2012 | Esenwein | B24B 23/028 451/452 |
| 2013/0000935 | A1* | 1/2013 | Kelleher | B23Q 11/08 173/46 |

FOREIGN PATENT DOCUMENTS

| | | | |
|---|---|---|---|
| CN | 204565910 | U | 8/2015 |
| JP | 2000-135687 | A | 5/2000 |
| JP | 2012-61591 | A | 3/2012 |
| KR | 2001-0094090 | A | 10/2001 |

OTHER PUBLICATIONS

Aug. 5, 2021 Office Action issued in Chinese Patent Application No. 201910074206.1.
May 7, 2022 Office Action issued in Chinese Patent Application No. 201910074206.1.

* cited by examiner

ELECTRIC POWER TOOL

CROSS-REFERENCE

This application claims priority to Japanese Patent Application No. 2018-031295, filed on Feb. 23, 2018, the entire contents of which are incorporated herein by reference.

TECHNICAL FIELD

The technique disclosed herein relates to an electric power tool.

BACKGROUND

Japanese Patent Application Publication No. 2000-135687 describes an electric power tool provided with a motor, a reducer mechanism connected to the motor, a housing that houses the motor and the reducer mechanism, a tool holder connected to the reducer mechanism, and a cover covering at least a part of the tool holder. The cover includes an engaging rib. The housing includes an engaging wall that engages with the engaging rib. The engaging wall is provided with a notch through which the engaging rib passes when the cover is attached to the housing.

SUMMARY

When an electric power tool is used, its cover needs to be surely attached for the sake of user's safety. However, if the configuration allows a user to freely remove the cover, the electric power tool may be used in a state where the cover is removed. In view of this, a technique that can prevent a cover from being removed by a user with a simple configuration is being desired.

The disclosure herein discloses an electric power tool. This electric power tool may comprise a motor; a power transmission mechanism connected to the motor; a housing that houses the motor and the power transmission mechanism; a tool holder projecting from the housing; a cover covering at least a part of a tool attached to the tool holder; and a mask member. The cover may include an engaging portion that engages with the housing. The mask member may have a shape that blocks visibility of at least a part of the engaging portion.

According to the above configuration, the mask member blocks visibility of at least a part of the engaging portion, and thus it is possible to prevent a user from visibly checking a state of the engaging portion to disengage the engagement between the cover and the housing. Removal of the cover by the user can be prevented with the simple configuration.

The disclosure herein discloses another electric power tool. This electric power tool may comprise a motor; a power transmission mechanism connected to the motor; a housing that houses the motor and the power transmission mechanism; a tool holder connected to the power transmission mechanism; a cover covering at least a part of the tool holder; a stopper member prohibiting removal of the cover. The stopper member may be screwed to the housing. The stopper member may have a shape that allows rotation of the stopper member in a direction along which the stopper member is attached to the housing from outside of the housing and prohibits rotation of the stopper member in a direction along which the stopper member is removed from the housing from the outside of the housing.

According to the above configuration, the stopper member can prevent the cover from being removed from the housing by the user. Further, according to the above configuration, it is possible to prevent the user from removing the stopper member to remove the cover from the housing. Removal of the cover by the user can be prevented with the simple configuration.

DETAILED DESCRIPTION

Figure 1:
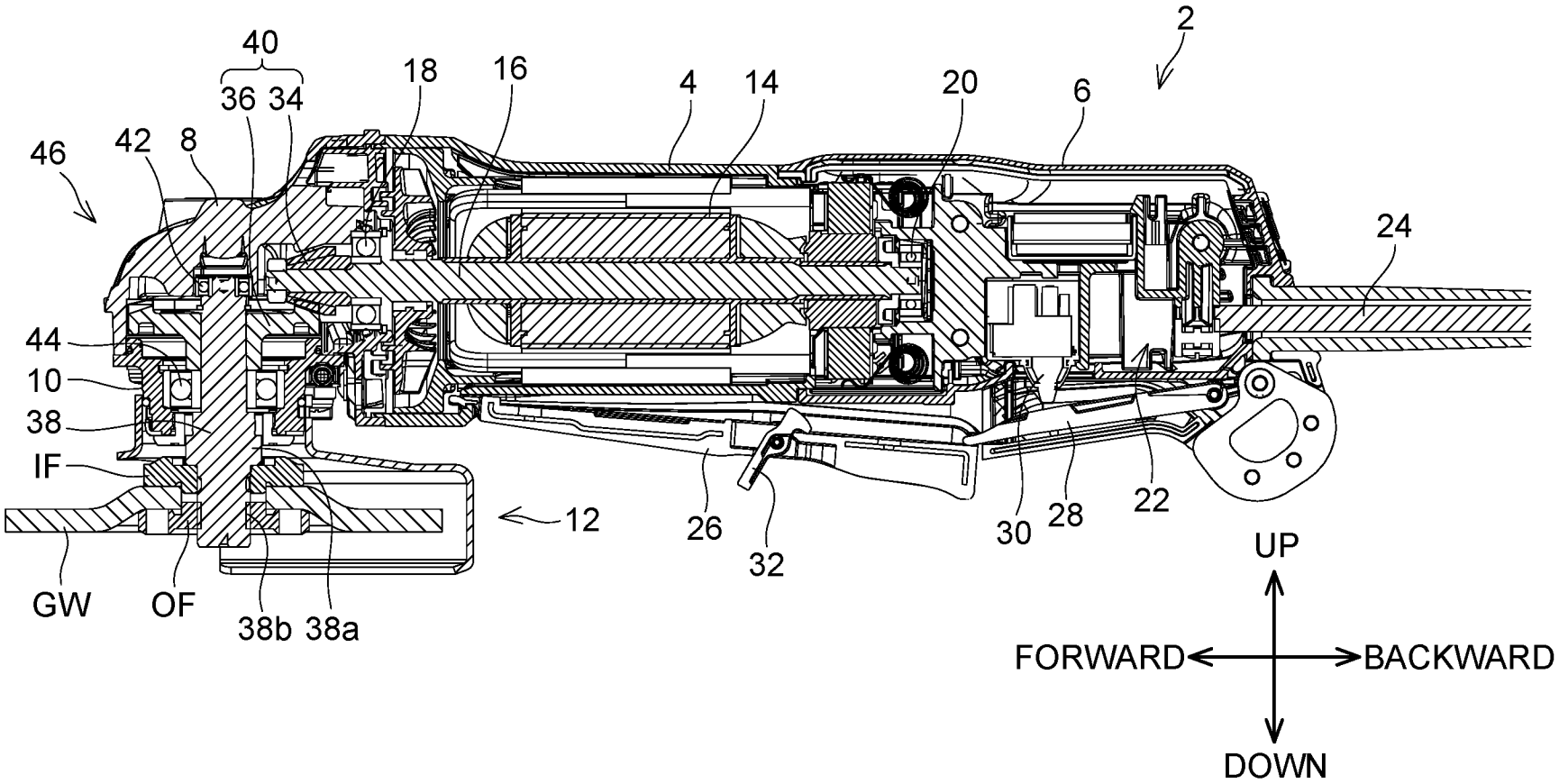
FIG. 1 is a longitudinal cross-sectional view of a grinder 2 according to a first embodiment.

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved electric power tools, as well as methods for using and manufacturing the same.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, an electric power tool may comprise a motor; a power transmission mechanism connected to the motor; a housing that houses the motor and the power transmission mechanism; a tool holder projecting from the housing; a cover covering at least a part of a tool attached to the tool holder; and a mask member. The cover may include an engaging portion that engages with the housing. The mask member may have a shape that blocks visibility of at least a part of the engaging portion.

According to the above configuration, the mask member blocks visibility of at least a part of the engaging portion of the cover, and thus it is possible to prevent a user from visibly checking a state of the engaging portion to disengage the engagement between the cover and the housing. Removal of the cover by the user can be prevented with the simple configuration.

In one or more embodiments, the engaging portion may include an engaging rib, the housing may include an engaging wall that engages with the engaging rib, and the engaging wall may include a notch through which the engaging rib passes when the cover is attached to the housing.

According to the above configuration, the engagement between the engaging wall and the engaging rib is disengaged when the engaging rib is aligned with the notch. However, since the mask member blocks visibility of the engaging rib, it is possible to prevent the user from aligning the engaging rib with the notch to remove the cover from the housing. Removal of the cover by the user can be prevented with the simple configuration.

In one or more embodiments, the mask member may include a mask plate shielding the notch, and a retainer fixing the mask plate to the housing.

According to the above configuration, the user cannot visually check the engaging rib from outside of the housing through the notch, and thus it is possible to prevent the user from aligning the engaging rib with the notch to remove the cover from the housing. Further, according to the above configuration, the notch of the engaging wall is shielded by the mask plate fixed to the housing. Therefore, even if the engaging rib is aligned with the notch, the mask plate engages with the engaging rib to prevent removal of the cover. Removal of the cover by the user can be prevented with the simple configuration.

In one or more embodiments, the retainer may be screwed to the housing. The retainer may have a shape that allows rotation of the retainer in a direction along which the retainer is attached to the housing from outside of the housing and prohibits rotation of the retainer in a direction along which the retainer is removed from the housing from the outside of the housing.

According to the above configuration, the mask plate is fixed to the housing by the retainer, and the retainer has the shape that prohibits removal of the retainer from the outside of the housing. Thus, it is possible to prevent the user from removing the mask plate and the retainer to remove the cover from the housing.

In one or more embodiments, the mask plate and the retainer may be separate parts.

According to the above configuration, each of the mask plate and the retainer can be formed in a simple shape that is easily manufactured.

In one or more embodiments, the mask member may be fixed to the cover.

According to the above configuration, removal of the cover by the user can be prevented without making a great modification to the existing housing of the electric power tool.

In one or more embodiments, the mask member may be engaged with the tool holder.

According to the above configuration, even if the engagement between the engaging portion of the cover and the housing is disengaged, removal of the cover is prohibited by the mask member fixed to the cover being engaged with the tool holder. Removal of the cover by the user can be prevented with the simple configuration.

In one or more embodiments, an electric power tool may comprise a motor; a power transmission mechanism connected to the motor; a housing that houses the motor and the power transmission mechanism; a tool holder connected to the power transmission mechanism; a cover covering at least a part of the tool holder; and a stopper member prohibiting removal of the cover. The stopper member may be screwed to the housing. The stopper member may have a shape that allows rotation of the stopper member in a direction along which the stopper member is attached to the housing from outside of the housing and prohibits rotation of the stopper member in a direction along which the stopper member is removed from the housing from the outside of the housing.

According the above configuration, the stopper member can prevent the user from removing the cover from the housing. Further, according to the above configuration, it is possible to prevent the user from removing the stopper member to remove the cover from the housing. Removal of the cover by the user can be prevented with the simple configuration.

First Embodiment

As shown in FIG. 1, a grinder 2 of a first embodiment comprises a motor housing 4, a rear housing 6, a gear housing 8, a bearing box 10, and a wheel cover 12.

The motor housing 4 houses a motor 14 therein. The motor 14 includes an output shaft 16 extending in a front-rear direction. The output shaft 16 is rotatably supported by the motor housing 4 via bearings 18, 20.

The rear housing 6 is attached to a rear part of the motor housing 4. The rear housing 6 houses a power supply circuit 22 therein. The power supply circuit 22 is supplied with electric power from an external power source through a power cord 24. A lower surface of the motor housing 4 is provided with a switch lever 26. When a user presses in the switch lever 26 upward, a link 28 makes contact with a drive switch 30, by which electric power is supplied to the motor 14. The motor 14 rotates the output shaft 16 by electric power supplied from the power supply circuit 22. When the user lets go of the switch lever 26, the link 28 separates from the drive switch 30, by which the electric power supply to the motor 14 is stopped. The switch lever 26 includes a lock-off lever 32 configured to switch between a state that allows a press-in operation on the switch lever 26 and a state that prohibits the press-in operation. In a state shown in FIG. 1, the press-in operation on the switch lever 26 by the user is prohibited. When the lock-off lever 32 is rotated, from that state, in a direction along which a lower end of the lock-off lever 32 moves rearward, the press-in operation on the switch lever 26 by the user is allowed.

Figure 2:
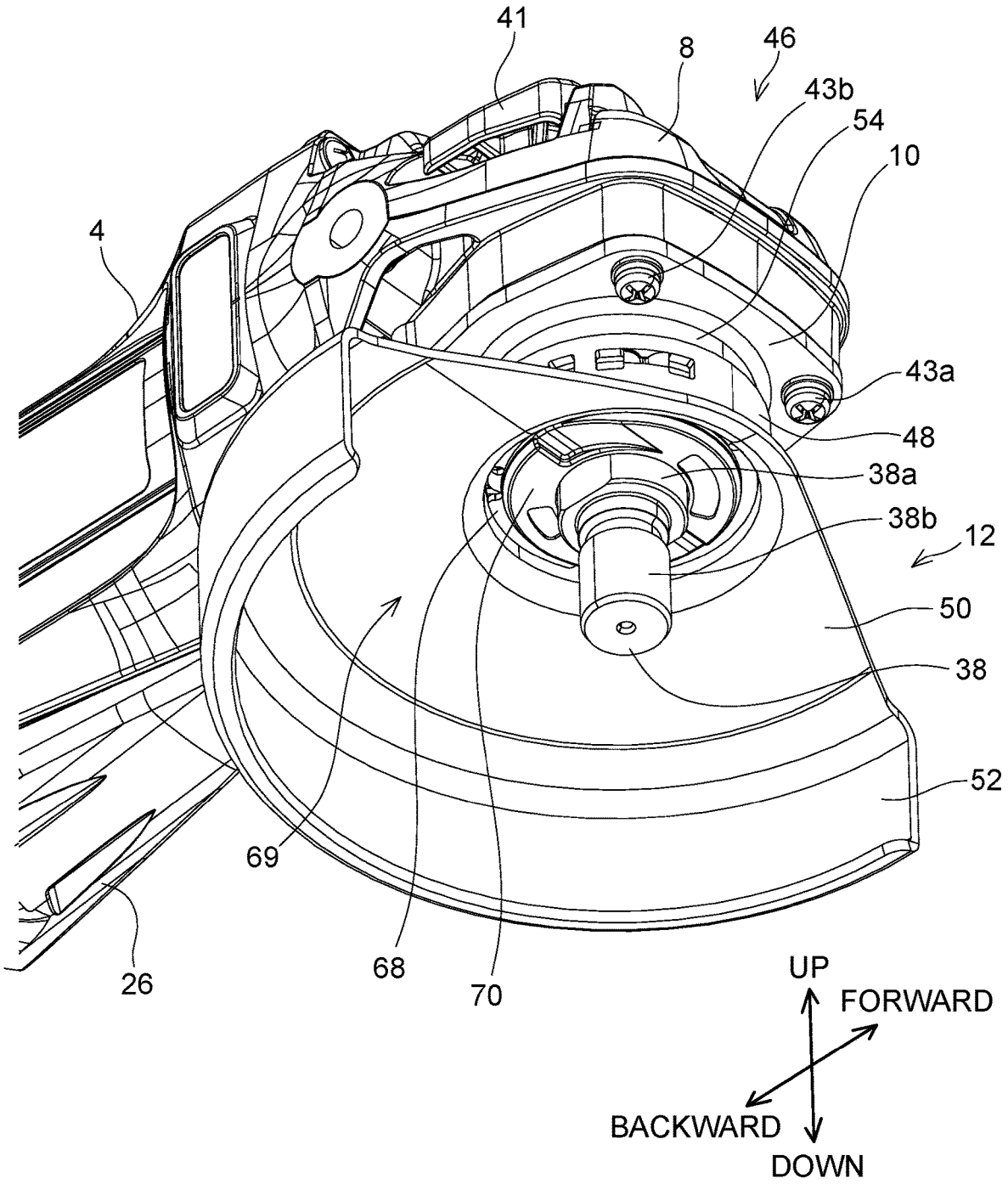
FIG. 2 is a perspective view showing a front part of the grinder 2 according to the first embodiment from lower front right side.

The gear housing 8 is attached to a front part of the motor housing 4. The gear housing 8 houses therein a first bevel gear 34 and a second bevel gear 36 that are arranged to mesh each other. The first bevel gear 34 is fixed to a front end portion of the output shaft 16. The second bevel gear 36 is fixed to an upper end portion of a spindle 38 extending in up-down direction. Hereinbelow, the first bevel gear 34 and the second bevel gear 36 may be collectively termed bevel gears 40, for simplicity. The bevel gears 40 is a power transmission mechanism configured to reduce a number of rotations of the motor 14 and transmit it to the spindle 38. The gear housing 8 holds the upper end portion of the spindle 38 via a bearing 42. As shown in FIG. 2, an upper surface of the gear housing 8 is provided with a shaft lock 41. When the user presses in the shaft lock 41 downward, rotation of the second bevel gear 36 is prohibited, by which rotation of the spindle 38 is prohibited.

As shown in FIG. 1, the bearing box 10 is attached to a lower portion of the gear housing 8. The bearing box 10 is fixed to the gear housing 8 with screws 43*a*, 43*b*, 43*c*, and 43*d* extending in the up-down direction (see FIGS. 2 and 5). The bearing box 10 holds the spindle 38 via a bearing 44. The spindle 38 is rotatable with respect to the bearing box 10 about its rotation axis along the up-down direction. A grinding wheel GW is attachable to a lower end portion of the spindle 38 via an inner flange IF and an outer flange OF. The spindle 38 is provided with a projection 38*a* configured to engage with the inner flange IF and a threaded portion 38*b* to which the outer flange OF is to be screwed. When the motor 14 rotates, the spindle 38 as well as the grinding wheel GW rotates around the rotation axis, by which the grinder 2 can grind a workpiece. The spindle 38 can be regarded as a tool holder that holds the grinding wheel GW, which is an example of a tool. Hereinbelow, the motor housing 4, the rear housing 6, the gear housing 8, and the bearing box 10 may be collectively termed a housing 46, for simplicity.

The bearing box 10 has the wheel cover 12 attached thereto. The wheel cover 12 has a shape that covers at least a part of the grinding wheel GW. In the present embodiment, the wheel cover 12 has a shape that covers the grinding wheel GW over approximately a half of its circumference. In the state shown in FIG. 1, the wheel cover 12 is arranged to cover a rear part of the grinding wheel GW. While the grinder 2 is used, the wheel cover 12 can prevent chips from flying toward the user from the grinding wheel GW. The wheel cover 12 can also be considered as covering at least a part of the spindle 38.

Figure 3:
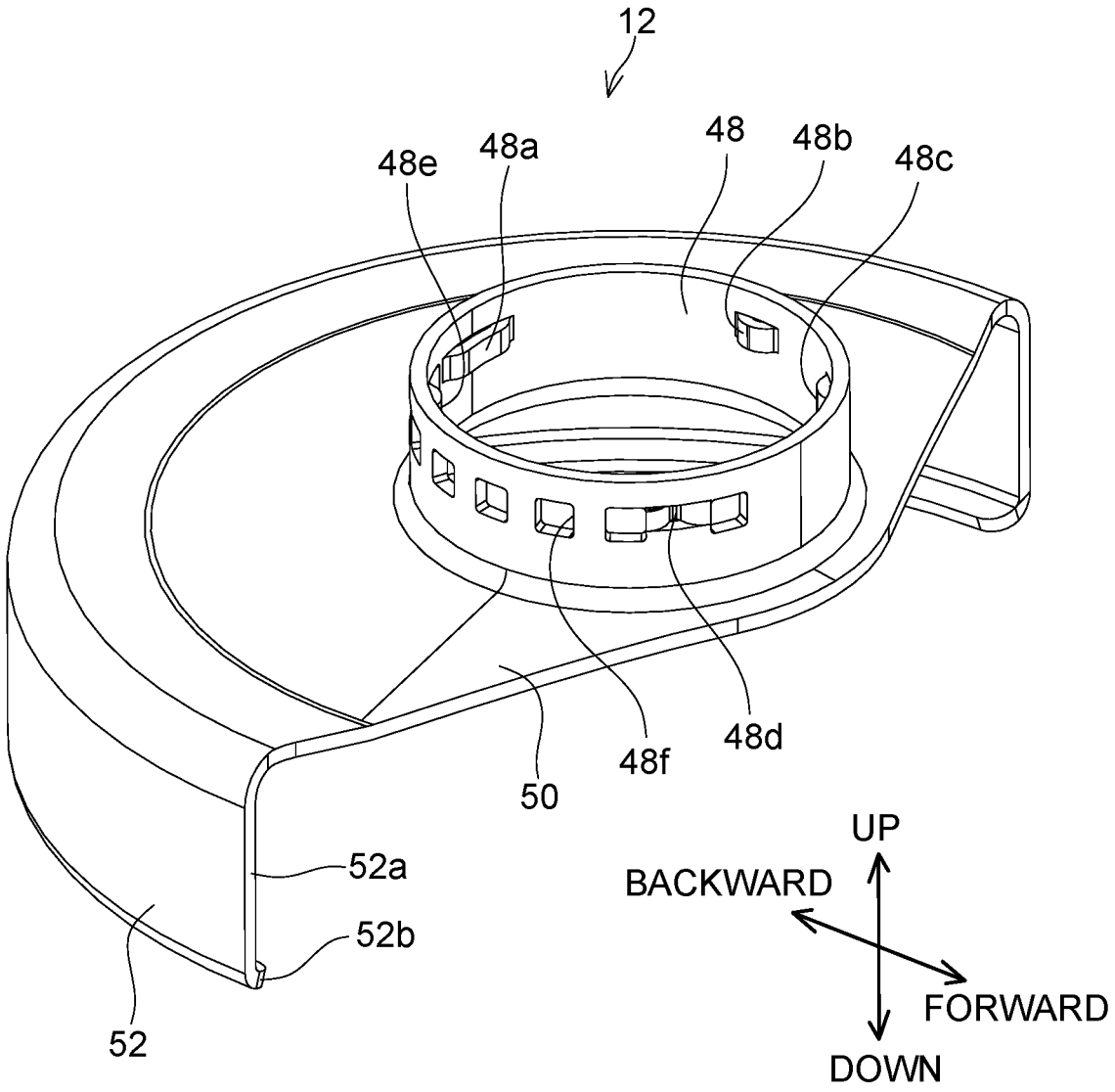
FIG. 3 is a perspective view of a wheel cover 12 of the grinder 2 according to the first embodiment.
Figure 4:
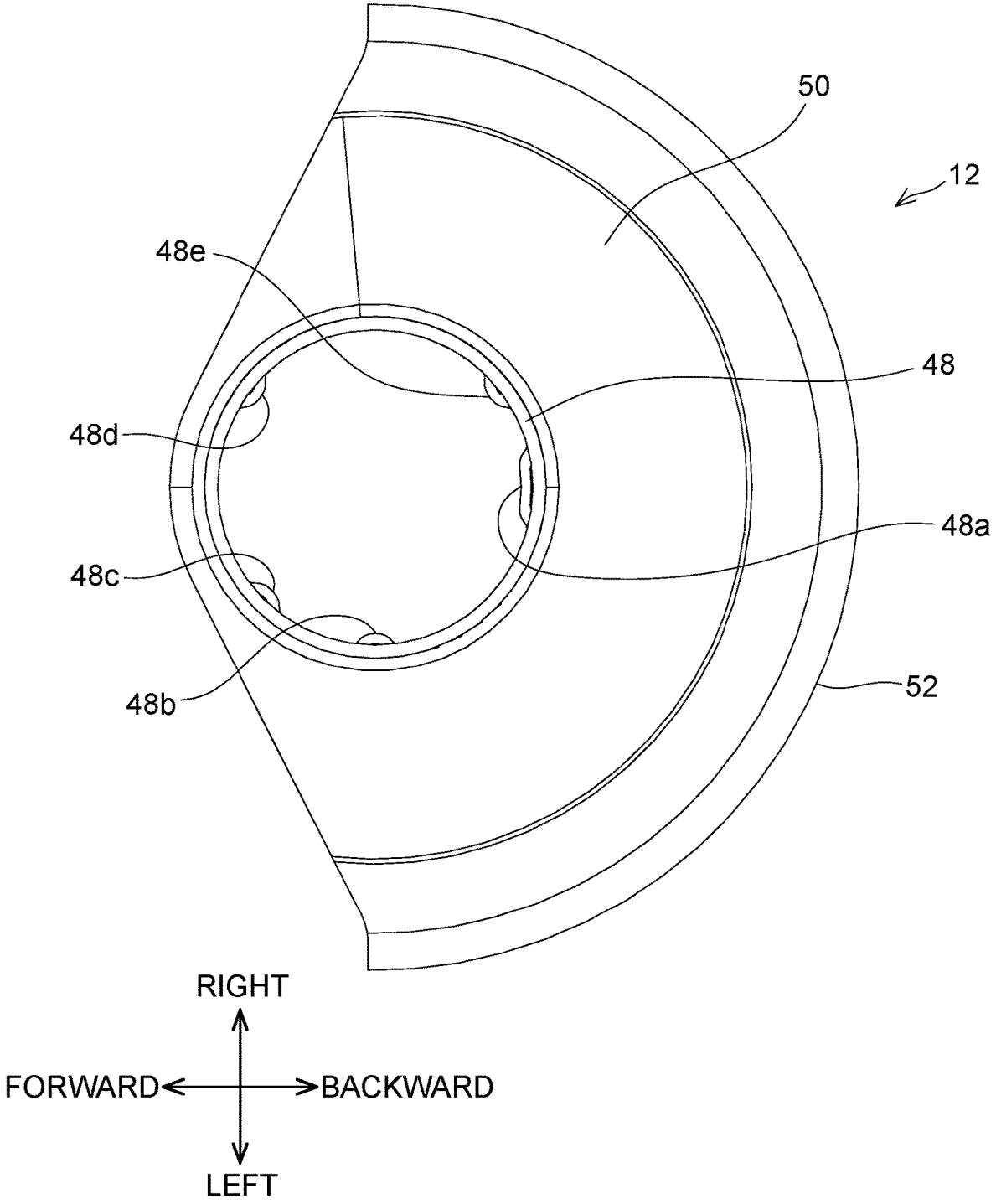
FIG. 4 is a top view of the wheel cover 12 of the grinder 2 according to the first embodiment.

As shown in FIG. 3, the wheel cover 12 includes a band portion 48, an upper surface portion 50, and a side surface portion 52. The band portion 48 has a substantially cylindrical shape extending in the up-down direction. As shown in FIG. 4, an inner surface of the band portion 48 is provided with engaging ribs 48*a*, 48*b*, 48*c*, 48*d*, and 48*e* that each project inward and have a longitudinal direction in a circumferential direction of the band portion 48. Further, as shown in FIG. 3, the band portion 48 is provided with a plurality of through holes 48*f* arranged within a predetermined angular range. Positions of the engaging ribs 48*a*, 48*b*, 48*c*, 48*d*, and 48*e* are same in the up-down direction. Further, positions of the through holes 48*f* are same in the up-down direction. The upper surface portion 50 expands from a lower end portion of the band portion 48 and has a shape of circular truncated cone with a part thereof cut off. The side surface portion 52 includes a semi-cylinder portion 52*a* that has a substantially semi-cylindrical shape and extends downward from an outer end portion of the upper surface portion 50, and a narrowing portion 52*b* that bends inward from a lower end of the semi-cylinder portion 52*a*.

Figure 5:
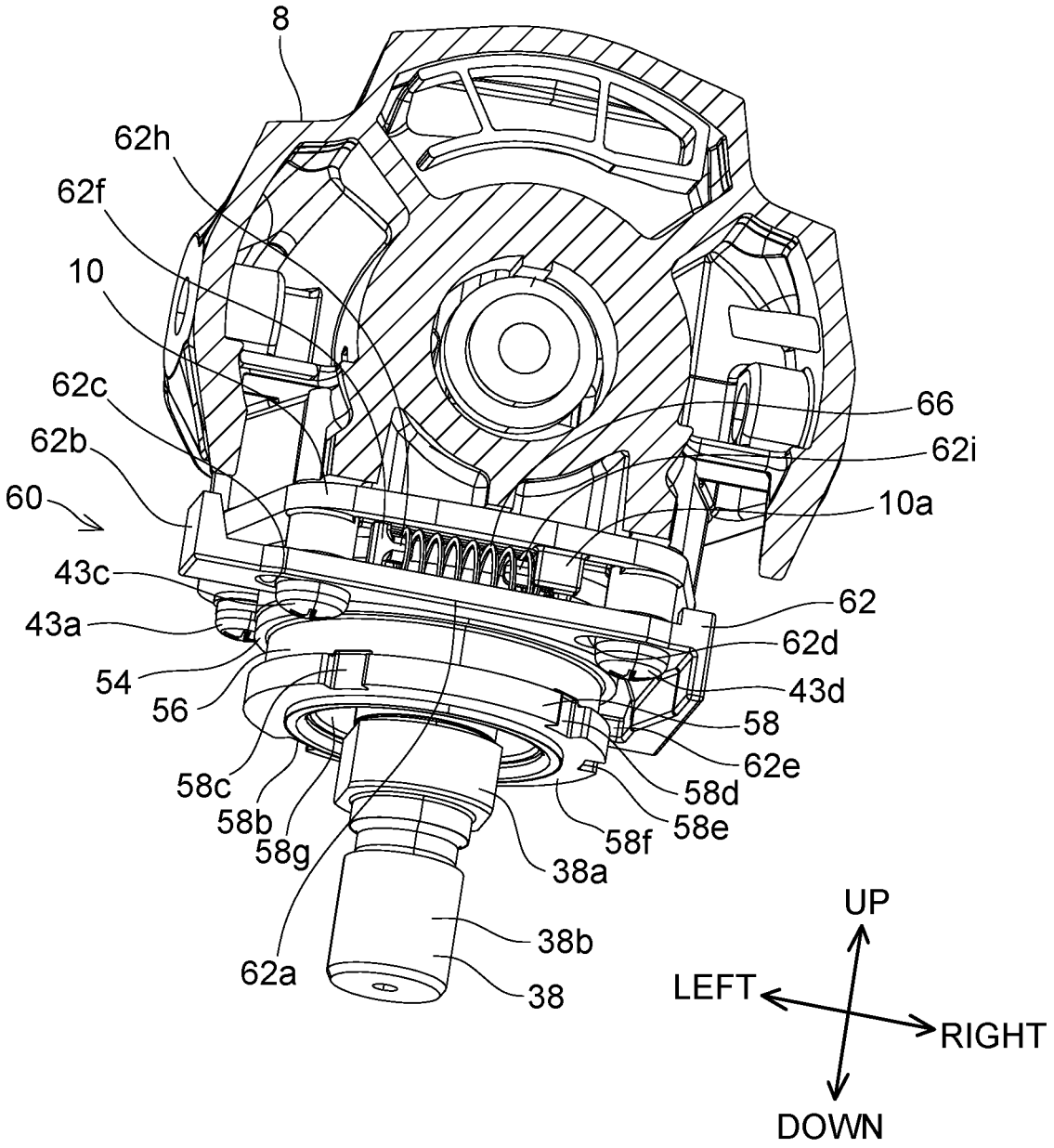
FIG. 5 is a perspective cross-sectional view showing structures of a bearing box 10 and a lock mechanism 60 of the grinder 2 according to the first embodiment from lower rear left side.

As shown in FIG. 5, the bearing box 10 includes a cover mounting portion 54 that has a substantially cylindrical shape and projects downward along a rotation-axis direction of the spindle 38 (i.e., along the up-down direction). The cover mounting portion 54 is provided with a circular guide groove 56 in its outer surface, and is provided with a flange 58 that projects outward on its lower end side relative to the guide groove 56. The flange 58 is provided with notches 58*a*, 58*b*, 58*c*, 58*d*, and 58*e* that respectively correspond to the engaging ribs 48*a*, 48*b*, 48*c*, 48*d*, and 48*e* of the wheel cover 12. The notches 58*a*, 58*b*, 58*c*, 58*d*, and 58*e* extend in the up-down direction and communicate with the guide groove 56. A lower surface of the flange 58 is provided with a mounting surface 58*f* for mounting a mask plate 68 to be described later. Further, the cover mounting portion 54 is provided with an internal thread 58*g* in its inner surface.

A lock mechanism 60 configured to fix a rotation angle of the wheel cover 12 is attached to the bearing box 10. The lock mechanism 60 includes a lock plate 62 and a compression spring 66.

Figure 6:
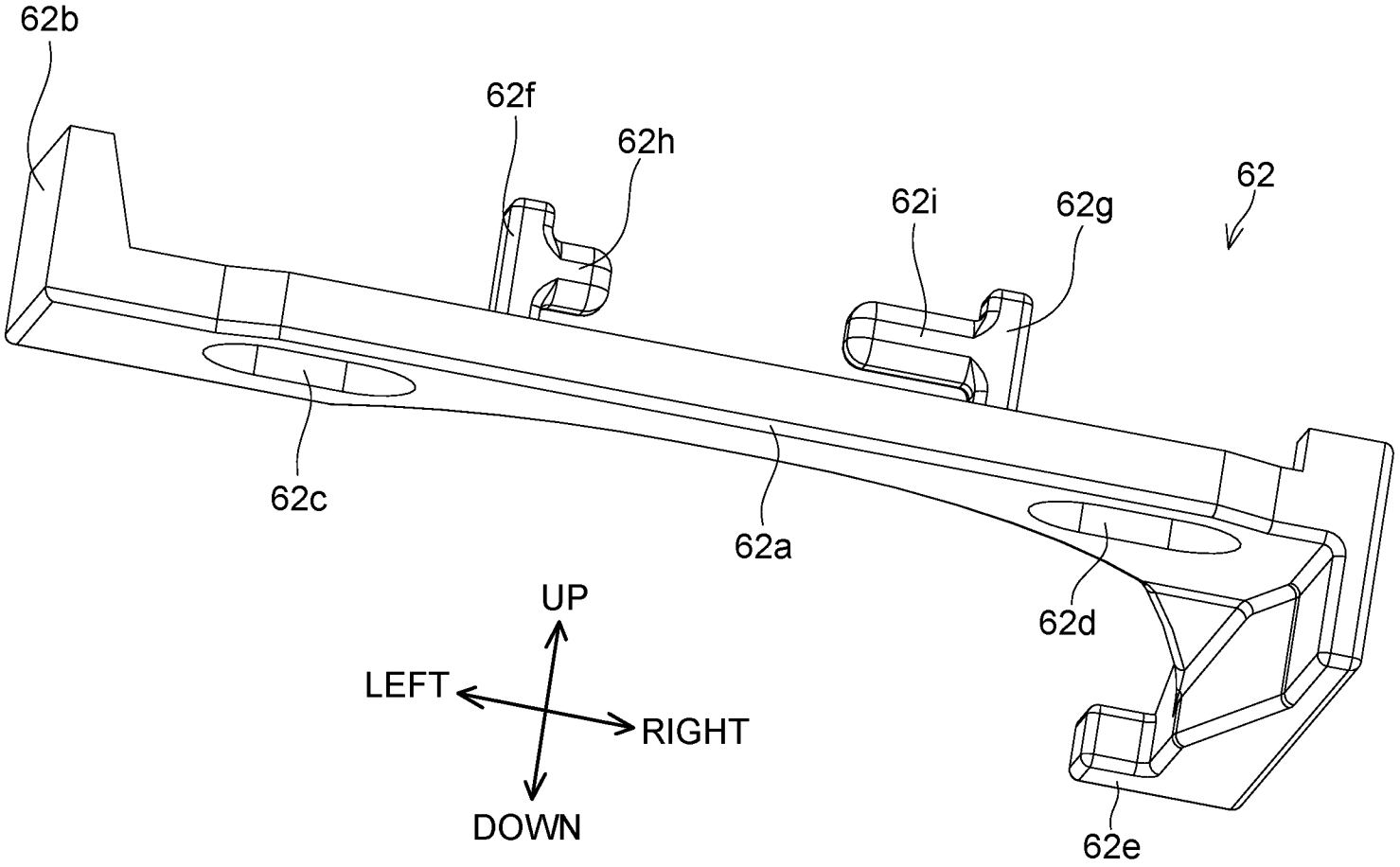
FIG. 6 is a perspective view of a lock plate 62 of the grinder 2 according to the first embodiment.

As shown in FIG. 6, the lock plate 62 includes a flat-plate shaped base portion 62*a* that extends in a right-left direction such that it does not interfere with the gear housing 8 nor the bearing box 10; an operation portion 62*b* that extends upward from a left end portion of the base portion 62*a*; long holes 62*c*, 62*d* that are provided in the base portion 62*a* and each have a longitudinal direction along the right-left direction; an engaging portion 62*e* that projects toward left side in a vicinity of a right end portion of the base portion 62*a*; a first pillar 62*f* and a second pillar 62*g* that project upward between the long hole 62*c* and the long hole 62*d* of the base portion 62*a*; a first projection 62*h* that extends from the first pillar 62*f* toward right side (toward the second pillar 62*g*); and a second projection 62*i* that extends from the second pillar 62*g* toward the left side (toward the first pillar 620.

Among the screws 43*a*, 43*b*, 43*c*, and 43*d* that fix the bearing box 10 to the gear housing 8, the lock plate 62 is attached to the screw 43*c* located on rear left side and the screw 43*d* located on rear right side, as shown in FIG. 5. The screw 43*c* passes through the long hole 62*c* of the lock plate 62 to fasten the bearing box 10 and the gear housing 8 together. The screw 43*d* passes through the long hole 62*d* of the lock plate 62 to fasten the bearing box 10 and the gear housing 8 together. The lock plate 62 is held by the screws 43*c*, 43*d* to be slidable in the right-left direction.

In the grinder 2 of the present embodiment, the bearing box 10 includes a spring receiver 10*a*. The compression spring 66 is attached to the lock plate 62 in a state where the first projection 62*h* is inserted in one end of the compression spring 66 and the second projection 62*i* is inserted in other end of the compression spring 66. The lock plate 62 is attached to the bearing box 10 such that the end of the compression spring 66 on second projection 62*i* side makes contact with the spring receiver 10*a*. Due to this, the compression spring 66 biases the lock plate 62 in the left direction with respect to the bearing box 10, that is, the compression spring 66 biases the lock plate 62 in a direction that brings the engaging portion 62*e* close to the cover mounting portion 54.

As shown in FIG. 2, a mask member 69 is attached to the cover mounting portion 54 of the bearing box 10 in the grinder 2 of the present embodiment. The mask member 69 includes a mask plate 68 and a retainer 70.

Figure 7:
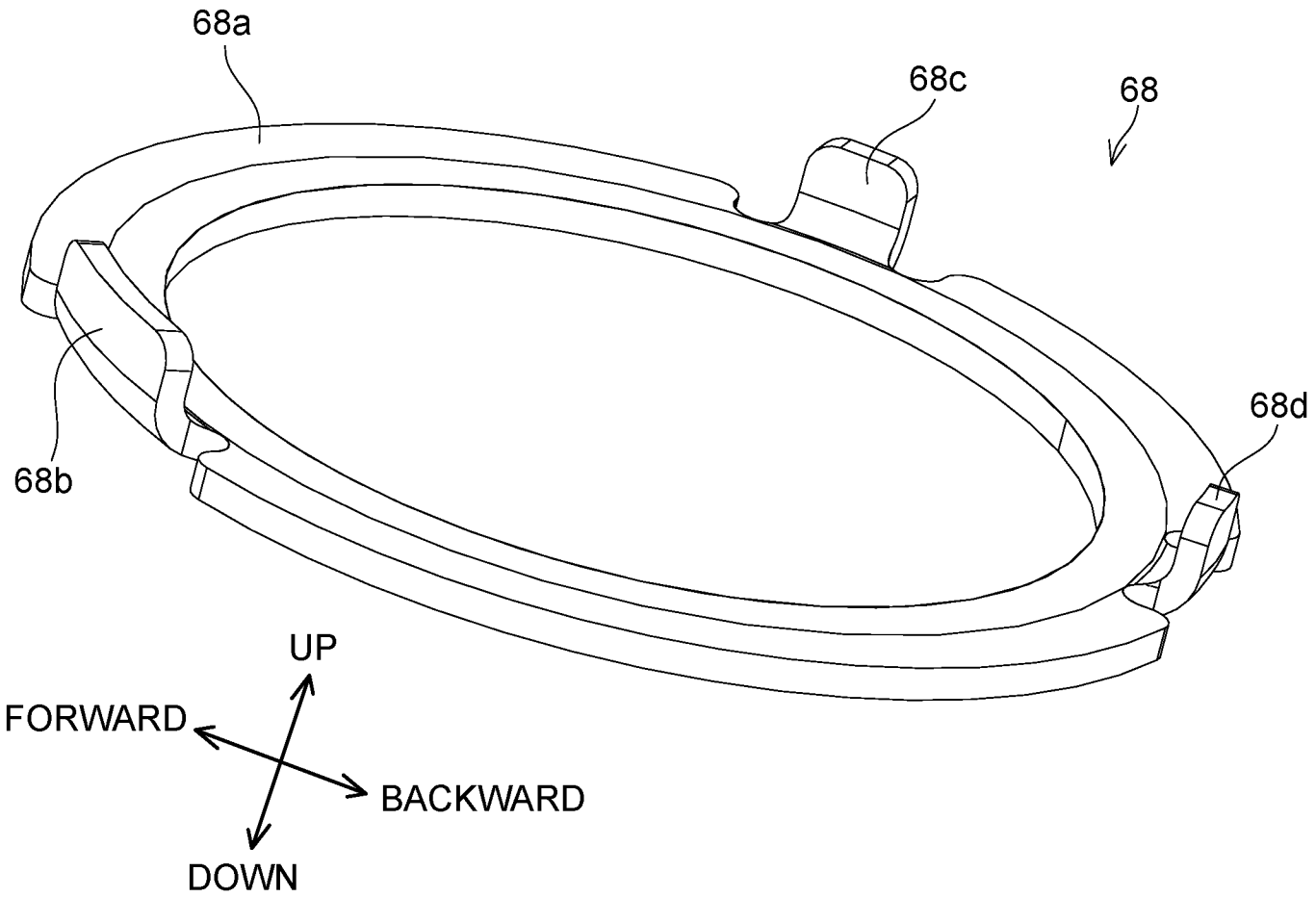
FIG. 7 is a perspective view of a mask plate 68 of the grinder 2 according to the first embodiment.

As shown in FIG. 7, the mask plate 68 includes a ring portion 68*a* that has a broad ring shape and insertion pieces 68*b*, 68*c*, and 68*d* that bend upward from the ring portion 68*a*. The mask plate 68 can be attached to the mounting surface 58*f* (see FIG. 5) of the flange 58 of the cover mounting portion 54. When the mask plate 68 is attached to the mounting surface 58*f*, the insertion pieces 68*b*. 68*c*, and 68*d* are respectively inserted to the notches 58*a*, 58*c*, and 58*d*. In a state where the mask plate 68 is attached to the mounting surface 58*f*, the notches 58*a*, 58*c*, and 58*d* are covered by the insertion pieces 68*b*, 68*c*, and 68*d*, and the notches 58*b*, 58*e* are covered by the ring portion 68*a*.

Figure 8:
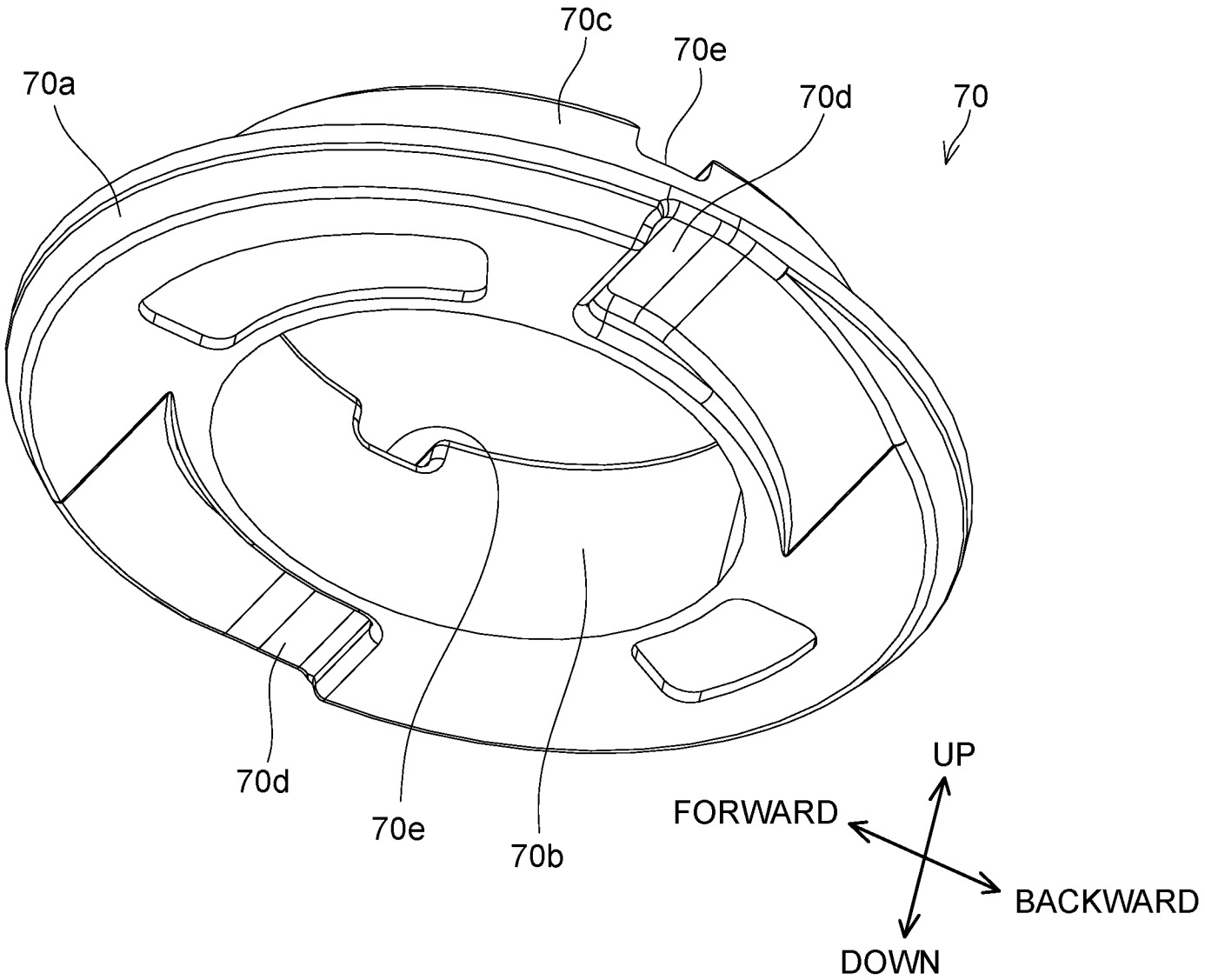
FIG. 8 is a perspective view showing a retainer 70 of the grinder 2 according to the first embodiment from lower front left side.
Figure 9:
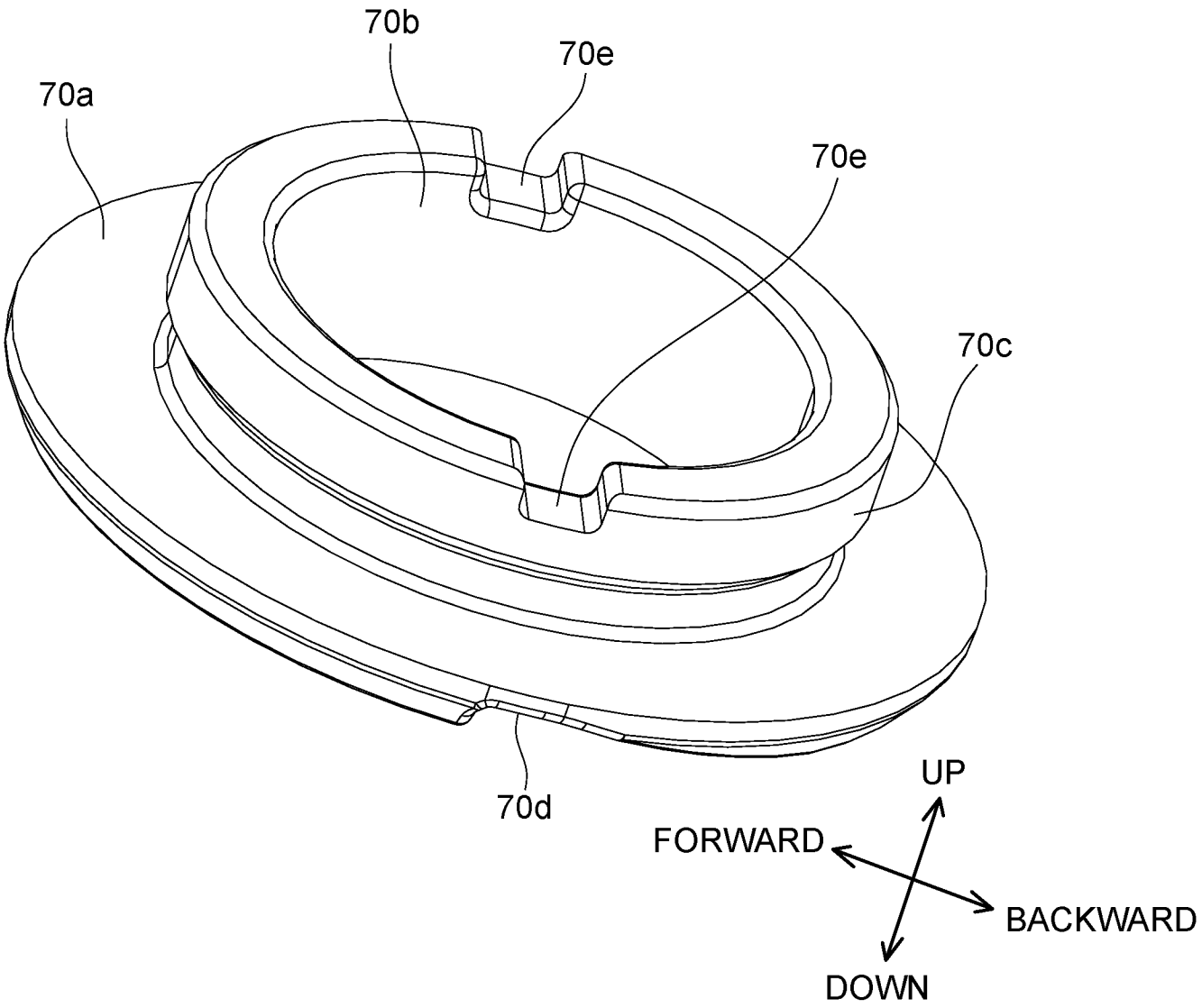
FIG. 9 is a perspective view showing the retainer 70 of the grinder 2 according to the first embodiment from upper front left side.

As shown in FIGS. 8 and 9, the retainer 70 includes a lid portion 70*a* that has a broad ring shape, and a shaft portion 70*b* that has a cylindrical shape and extends upward from the lid portion 70*a*. An outer diameter of the lid portion 70*a* is larger than an inner diameter of the ring portion 68*a* of the mask plate 68 and is smaller than an outer diameter of the ring portion 68*a* of the mask plate 68. An outer surface of the shaft portion 70*b* is provided with an external thread 70*c* corresponding to the internal thread 58*g* of the cover mounting portion 54. As shown in FIG. 8, a lower surface of the lid portion 70*a* is provided with a groove 70*d* for rotating the retainer 70. In the groove 70*d*, a step is provided in a direction along which the external thread 70*c* advances (in a counterclockwise direction when the lid portion 70*a* is seen from below), and a gentle slope is provided in a direction along which the external thread 70*c* retreats (in a clockwise direction when the lid portion 70*a* is seen from below). Due to this, by using the groove 70*d* to rotate the retainer 70 counterclockwise with respect to the cover mounting portion 54, the external thread 70*c* of the retainer 70 can be screwed to the internal thread 58*g* of the cover mounting portion 54, as a result of which the retainer 70 can be attached to the cover mounting portion 54. Since the retainer 70 cannot be rotated clockwise with respect to the cover mounting portion 54 by using the groove 70*d*, the retainer 70 cannot be removed from the cover mounting portion 54 by using the groove 70*d*. As shown in FIG. 9, a notch 70*e* is provided in an upper end portion of the shaft portion 70*b*. The retainer 70 attached to the cover mounting portion 54 can be removed from the cover mounting portion 54 by using the notch 70*e* to rotate the retainer 70 with respect to the cover mounting portion 54 in the direction along which the external thread 70*c* retreats (in the clockwise direction when the lid portion 70*a* is seen from below).

Figure 10:
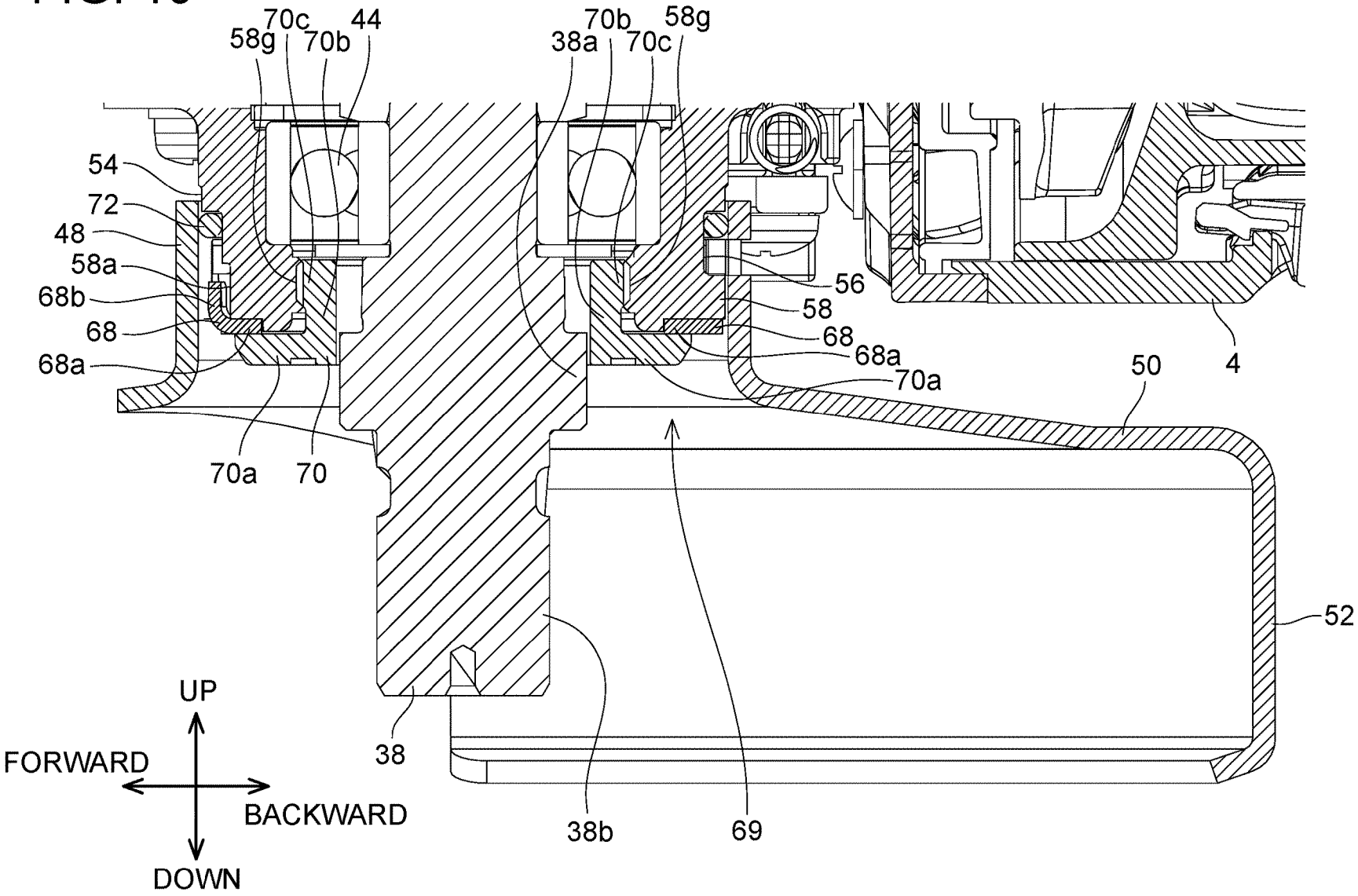
FIG. 10 is a cross sectional view of a portion to which a mask member 69 of the grinder 2 according to the first embodiment is attached.

As shown in FIG. 10, the retainer 70 is fixed to the cover mounting portion 54 by the external thread 70*c* being screwed to the internal thread 58*g* of the cover mounting portion 54 in a state where the mask plate 68 is interposed between the lid portion 70*a* and the flange 58 of the cover mounting portion 54. In a state where the wheel cover 12, the mask plate 68, and the retainer 70 are attached to the grinder 2, it is impossible to visibly check the notches 58*a*, 58*b*, 58*c*, 58*d* and 58*e* of the flange 58 and the engaging ribs 48*a*, 48*b*, 48*c*, 48*d* and 48*e* of the wheel cover 12 from outside. An O-ring 72 is interposed between an upper end of the band portion 48 of the wheel cover 12 and the cover mounting portion 54. The O-ring 72 can suppress backlash of the wheel cover 12 with respect to the cover mounting portion 54.

Figure 11:
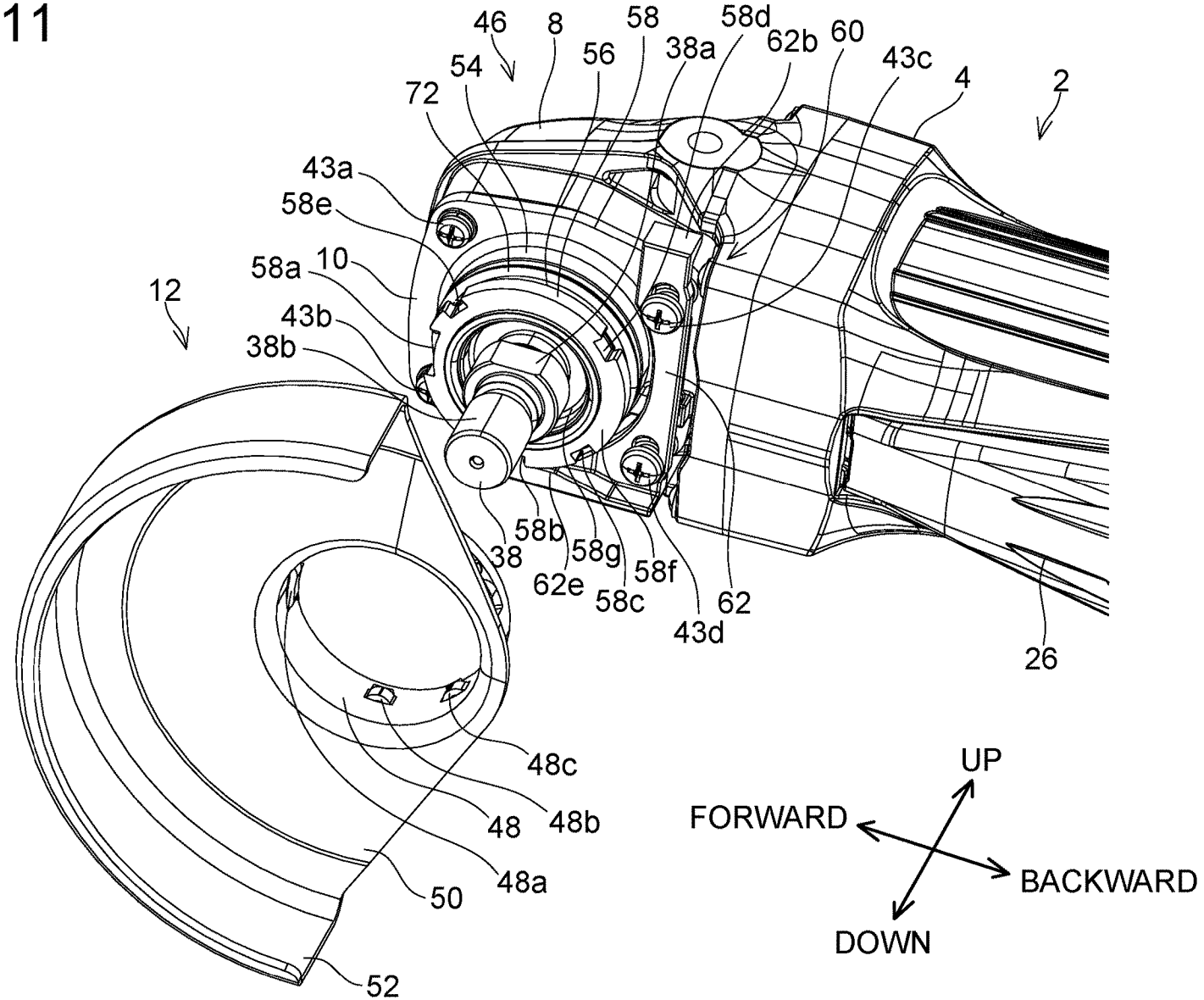
FIG. 11 is a perspective view showing the front part of the grinder 2 according to the first embodiment from lower rear left side, and shows a state before the wheel cover 12 is attached to the bearing box 10.
Figure 12:
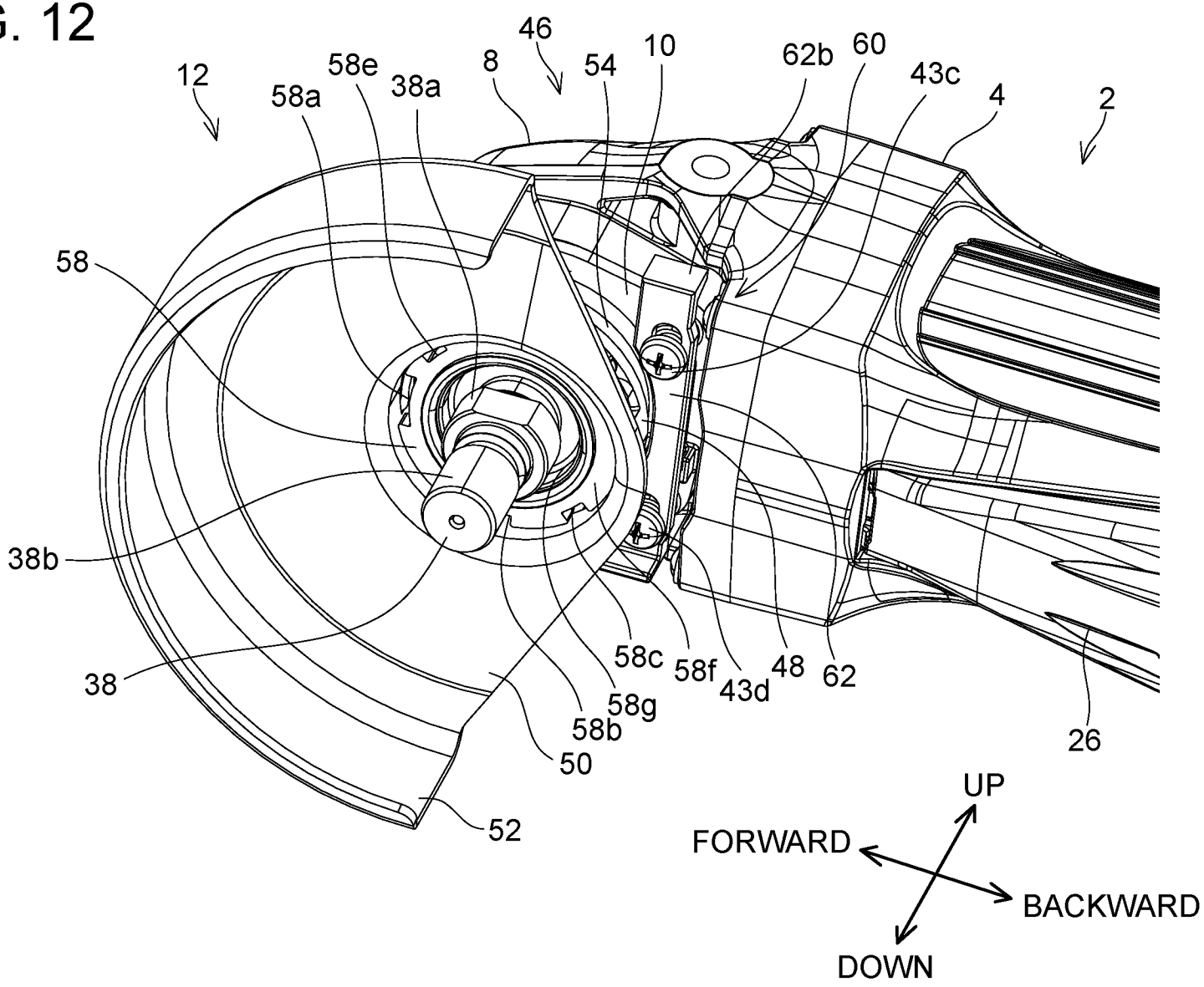
FIG. 12 is a perspective view showing the front part of the grinder 2 according to the first embodiment from lower rear left side, and shows a state after the wheel cover 12 has been attached to the bearing box 10.

As shown in FIG. 11, when the wheel cover 12 is to be attached to the grinder 2, firstly, the wheel cover 12 is attached to the cover mounting portion 54 in a state where the O-ring 72 is attached to the cover mounting portion 54. Specifically, in a state where the engaging ribs 48*a*, 48*b*, 48*c*, 48*d* and 48*e* of the wheel cover 12 are aligned with the notches 58*a*, 58*b*, 58*c*, 58*d* and 58*e* of the cover mounting portion 54, the operation portion 62*b* of the lock plate 62 is pressed in to separate the engaging portion 62*e* from the cover mounting portion 54, and then the wheel cover 12 is slid upward with respect to the bearing box 10 such that the cover mounting portion 54 is inserted into the band portion 48. As such, the wheel cover 12 is attached to the cover mounting portion 54 as shown in FIG. 12. A position of the wheel cover 12 that has already been attached to the bearing box 10 in the state where the engaging ribs 48*a*, 48*b*, 48*c*, 48*d* and 48*e* are aligned with the notches 58*a*, 58*b*. 58*c*. 58*d* and 58*e* may be termed a removable position hereinbelow.

The wheel cover 12 attached to the bearing box 10 can rotate about the cover mounting portion 54. In other words, the wheel cover 12 can rotate about the rotation-axis direction of the spindle 38 (i.e., the up-down direction) with respect to the bearing box 10. When the wheel cover 12 is rotated from the removable position with respect to the bearing box 10, the engaging ribs 48*a*, 48*b*, 48*c*, 48*d* and 48*e* slide in the guide groove 56 and the flange 58 engages with the engaging ribs 48*a*, 48*b*, 48*c*, 48*d* and 48*e*, by which the wheel cover 12 is prohibited from sliding downward with respect to the bearing box 10. In this state, the wheel cover 12 cannot be removed from the bearing box 10.

When the wheel cover 12 is rotated with respect to the bearing box 10 to align the engaging portion 62*e* of the lock plate 62 with one of the through holes 48*f* of the band portion 48 and the user lets go of the operation portion 62*b* of the lock plate 62, the engaging portion 62*e* is inserted into the one through hole 48*f* by a biasing force of the compression spring 66. In this state, the wheel cover 12 is engaged with the lock plate 62, and thus the wheel cover 12 is prohibited from rotating with respect to the bearing box 10 and the wheel cover 12 is fixed to the bearing box 10. When changing the rotation angle of the wheel cover 12 with respect to the bearing box 10, the user presses in the operation portion 62*b* of the lock plate 62 to get the engaging portion 62*e* out of the through hole 48*f*, as a result of which the user can rotate the wheel cover 12 with respect to the bearing box 10. The user can select with which rotation angle the wheel cover 12 is to be fixed to the bearing box 10 by appropriately selecting into which one of the through holes 48*f* the engaging portion 62*e* is to be inserted.

Figure 13:
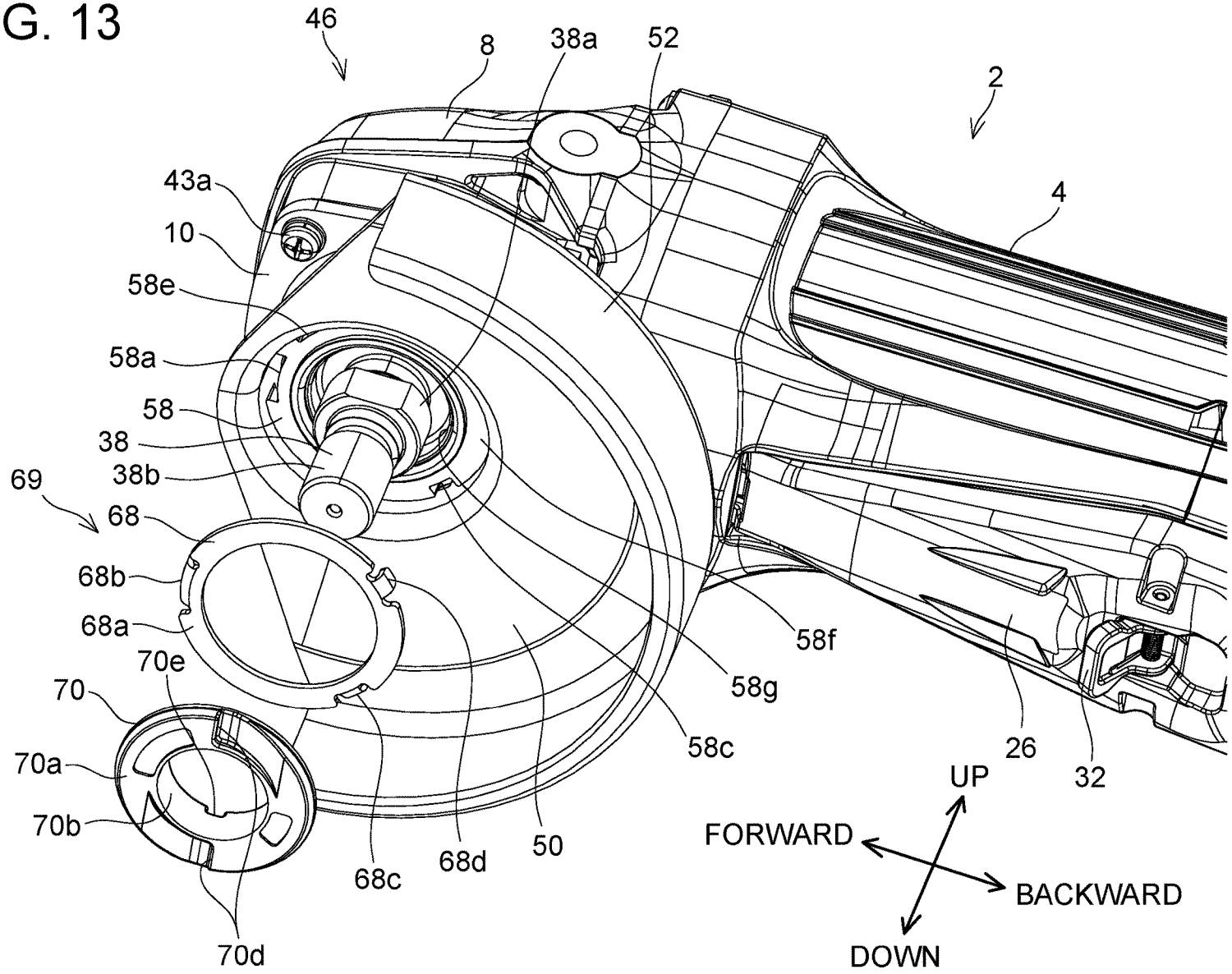
FIG. 13 is a perspective view showing the front part of the grinder 2 according to the first embodiment from lower rear left side, and shows a state before the mask member 69 is attached to the bearing box 10.

As shown in FIG. 13, after the wheel cover 12 has been rotated to a desired position, the mask plate 68 is attached to the mounting surface 58*f* of the flange 58 in a state where the insertion pieces 68*b*. 68*c* and 68*d* of the mask plate 68 are aligned with the notches 58*a*, 58*c* and 58*d* of the flange 58. In this state, the shaft portion 70*b* of the retainer 70 is inserted into the cover mounting portion 54 from below the mask plate 68, and the retainer 70 is rotated by using the groove 70*d* to screw the external thread 70*c* of the retainer 70 to the internal thread 58*g* of the cover mounting portion 54. As such, the mask member 69 is attached to the bearing box 10 as shown in FIG. 14.

Even in the state where the mask plate 69 is attached, the wheel cover 12 can rotate about the cover mounting portion 54. However, in this state, the mask plate 68 does not allow the notches 58*a*, 58*b*. 58*c*, 58*d* and 58*e* of the flange 58 and the engaging ribs 48*a*, 48*b*, 48*c*, 48*d* and 48*e* of the wheel cover 12 to be visually checked from outside. Due to this, it is possible to prevent the user from aligning the wheel cover 12 to the removable position to remove the wheel cover 12 from the bearing box 10. Further, even if the wheel cover 12 is aligned to the removable position and the engaging ribs 48*a*, 48*b*. 48*c*, 48*d* and 48*e* of the wheel cover 12 are aligned with the notches 58*a*, 58*b*, 58*c*, 58*d* and 58*e* of the flange 58, the wheel cover 12 is prohibited from sliding downward with respect to the bearing box 10 because the mask plate 68 engages with the engaging ribs 48*a*, 48*b*, 48*c*, 48*d* and 48*e* of the wheel cover 12. Due to this, the wheel cover 12 cannot be removed from the bearing box 10 in the state where the mask member 69 is attached. As such, the mask member 69 also functions as a stopper member configured to prohibit the wheel cover 12 from being removed from the bearing box 10.

Figure 14:
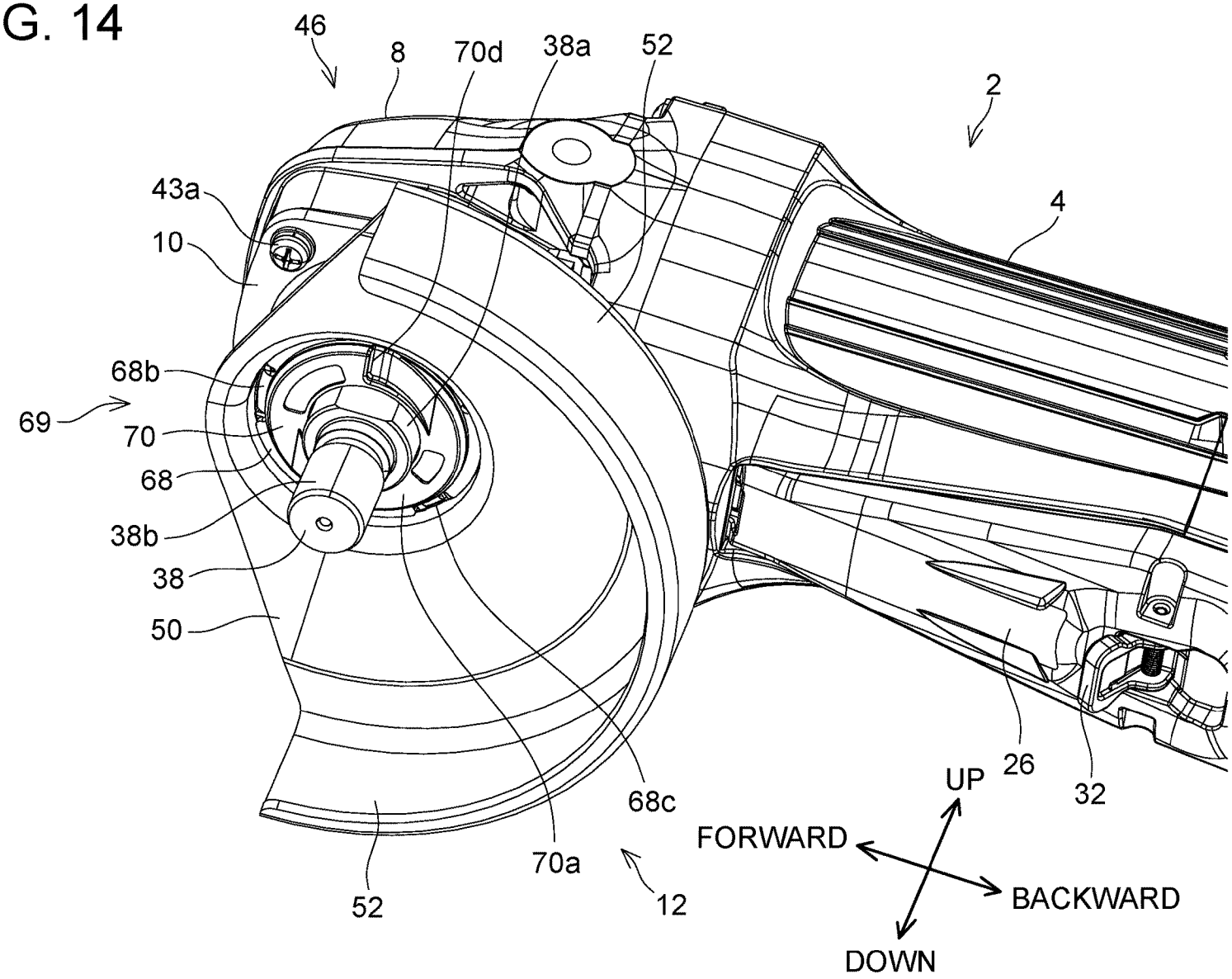
FIG. 14 a perspective view showing the front part of the grinder 2 according to the first embodiment from lower rear left side, and shows a state after the mask member 69 has been attached to the bearing box 10.
Figure 15:
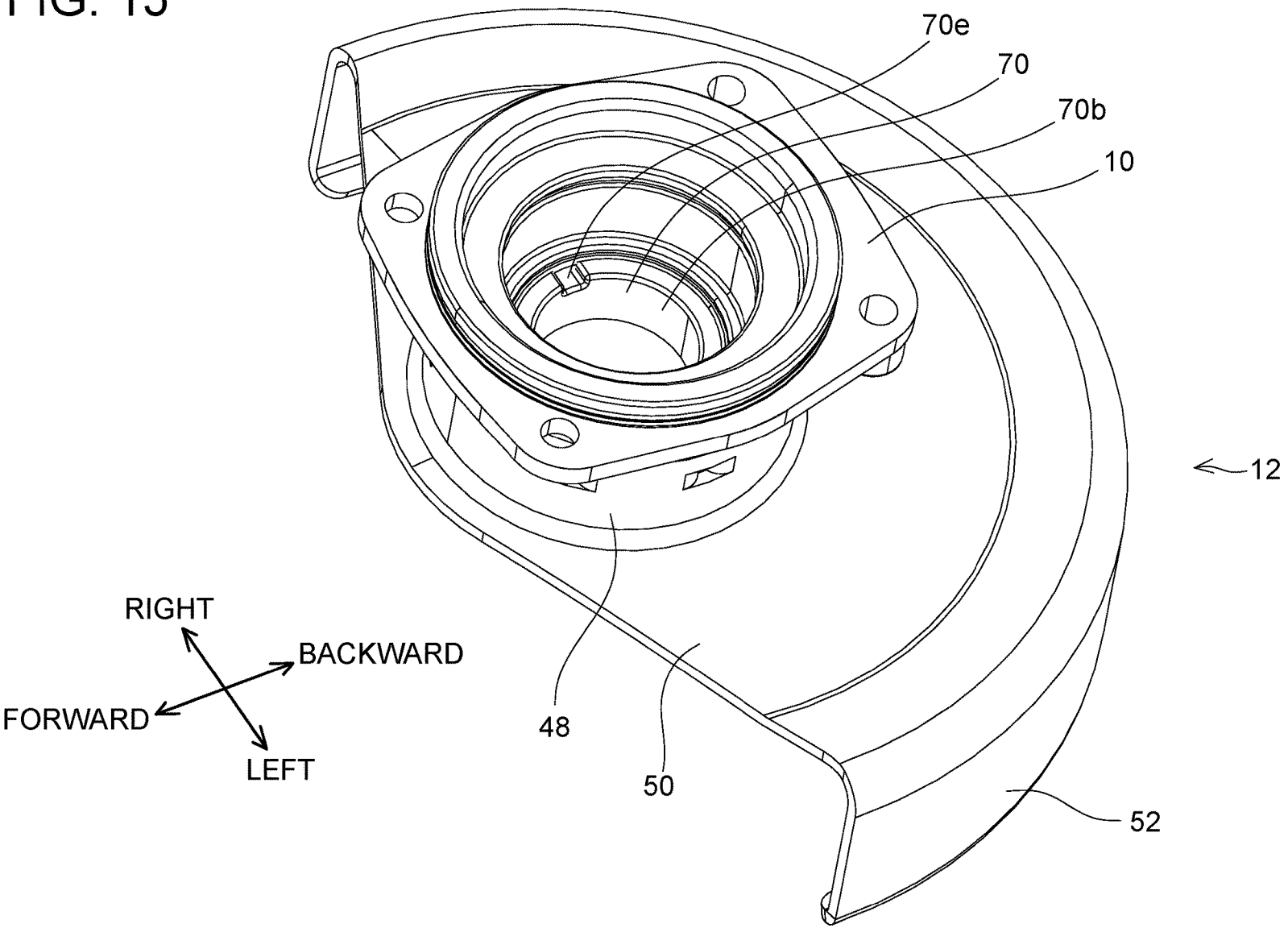
FIG. 15 is a perspective view showing a state where the bearing box 10 of the grinder 2 according to the first embodiment has been removed from a gear housing 8.

Since the retainer 70 cannot be rotated in the direction along which the external thread 70*c* retreats by using the groove 70*d* of the retainer 70, removal of the retainer 70 from the bearing box 10 is prohibited in the state shown in FIG. 14. To remove the retainer 70 from the bearing box 10, the bearing box 10 to which the wheel cover 12, the mask plate 68 and the retainer 70 are attached is removed from the gear housing 8, as shown in FIG. 15. Then, a tool is inserted to the bearing box 10 from above to rotate the retainer 70 with respect to the cover mounting portion 54 in the direction along which the external thread 70*c* retreats by using the notch 70*e* of the retainer 70. As a result, the retainer 70 can be removed from the bearing box 10, and the mask plate 68 can thereby be removed from the bearing box 10. When the retainer 70 and the mask plate 68 are removed, the wheel cover 12 can be removed from the bearing box 10. With such a configuration, maintainability can be ensured.

Figure 16:
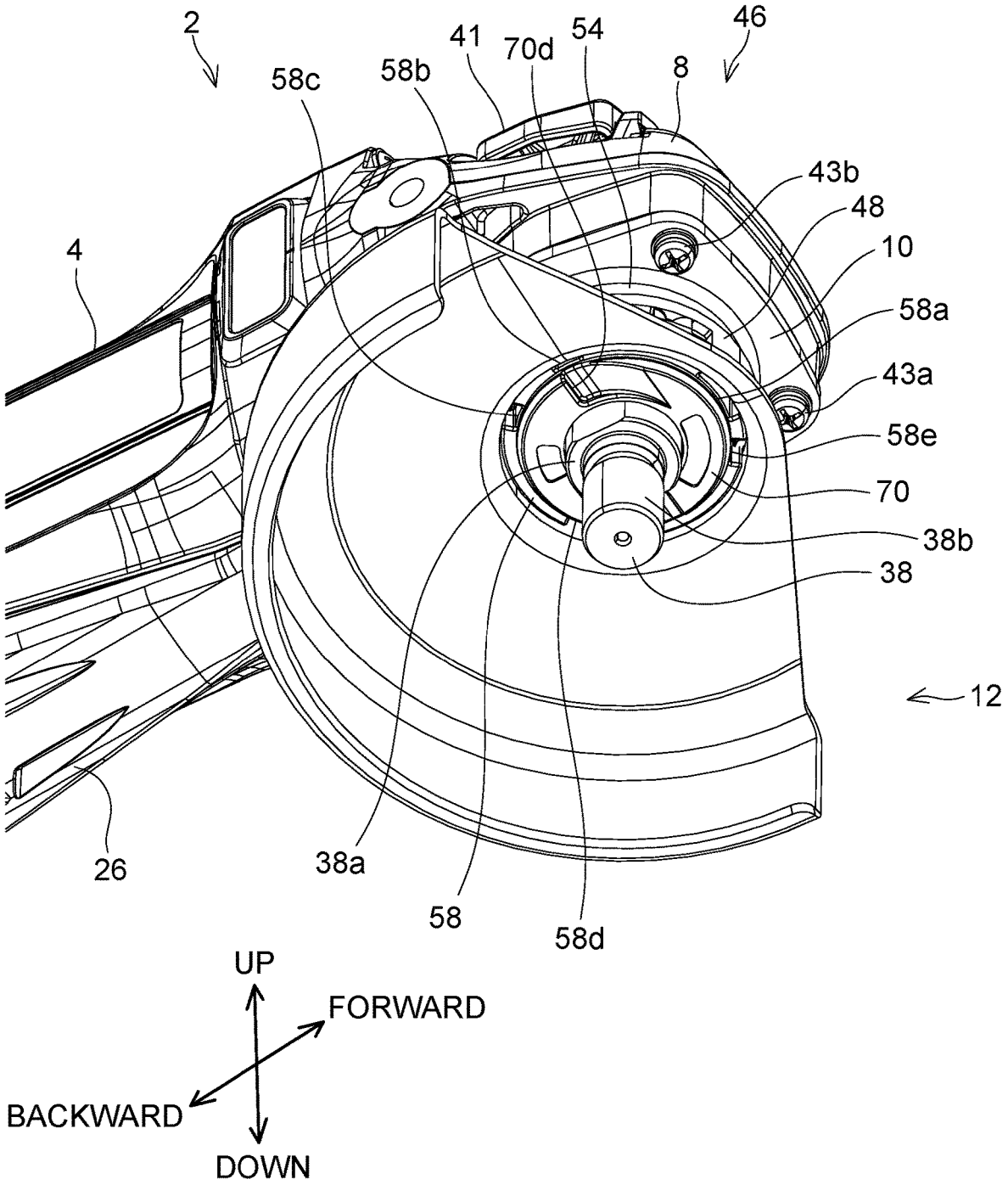
FIG. 16 is a perspective view showing the front part of the grinder 2 according to the first embodiment from lower front right side, and shows a state where the retainer 70 has been attached to the bearing box 10 without the mask plate 68 attached.
Figure 17:
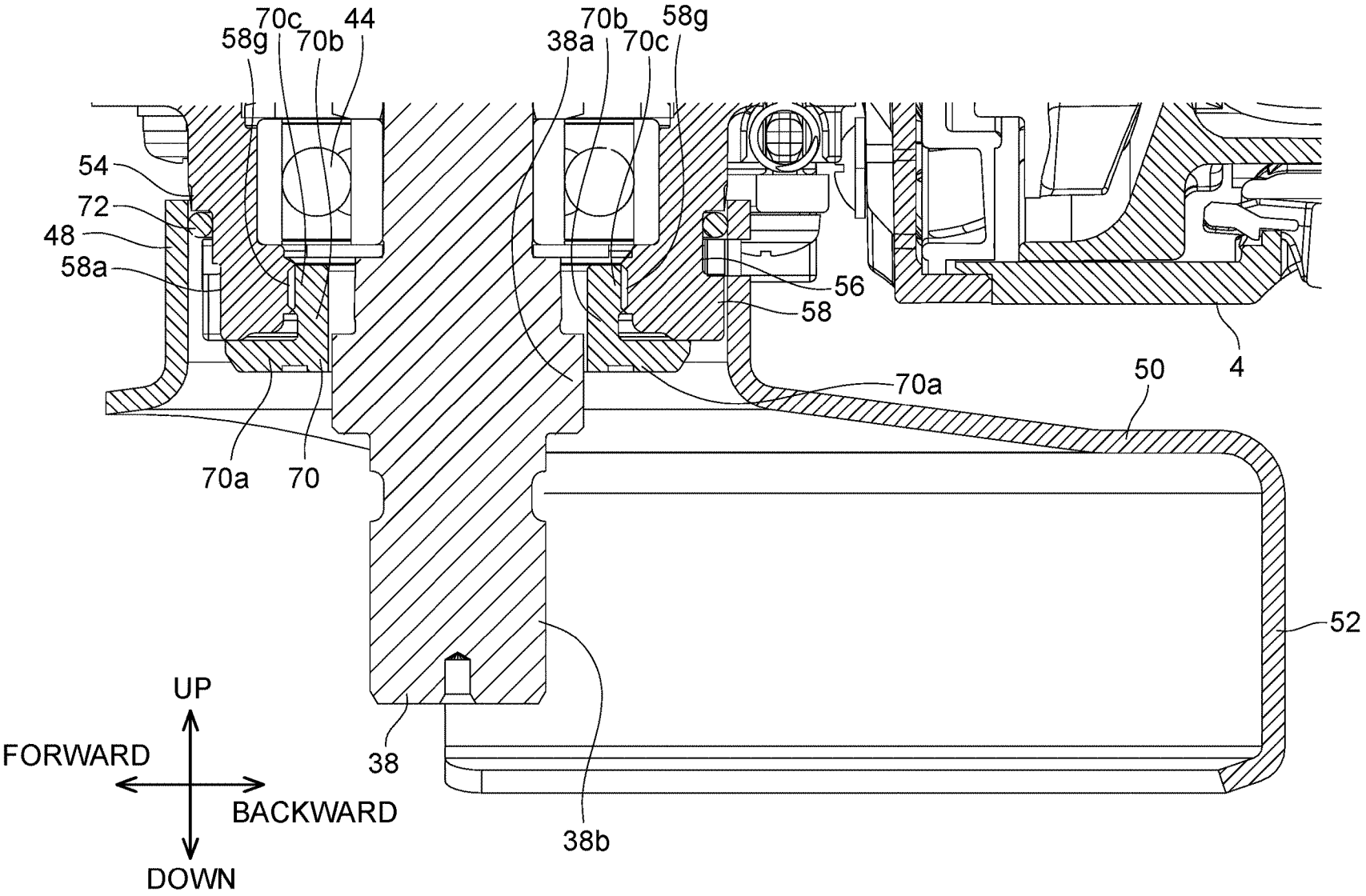
FIG. 17 is a cross sectional view of a portion to which the retainer 70 is attached, in a case where the retainer 70 is attached to the bearing box 10 of the grinder 2 according to the first embodiment without the mask plate 68 attached.

As shown in FIGS. 16 and 17, the grinder 2 of the present embodiment can employ a configuration where the mask plate 68 is not attached and only the retainer 70 is attached. In this case, as shown in FIG. 17, the lower surface of the flange 58 of the bearing box 10 is not provided with the mounting surface 58*f* but the lower surface of the flange 58 is configured to directly contact with the retainer 70. In the configuration shown in FIGS. 16 and 17, the user can visually check the notches 58*a*, 58*b*, 58*c*, 58*d* and 58*e* of the flange 58 and the engaging ribs 48*a*, 48*b*, 48*c*, 48*d* and 48*e* of the wheel cover 12 from outside. Further, the user can remove the wheel cover 12 from the bearing box 10 by sliding the wheel cover 12 downward with respect to the bearing box 10 in the state where the wheel cover 12 is aligned to the removable position.

The mask plate 68 and the retainer 70 may be separate parts as described above, or they may be integrated in a single part unlike the above.

As described above, in one or more embodiments, the grinder 2 (an example of electric power tool) comprises the motor 14, the bevel gears 40 (an example of power transmission mechanism) connected to the motor 14, the housing 46 that houses the motor 14 and the bevel gears 40, the spindle 38 (an example of tool holder) projecting from the housing 46, the wheel cover 12 (an example of cover) covering at least a part of the grinding wheel GW attached to the spindle 38, and the mask member 69. The wheel cover 12 includes the engaging ribs 48*a*. 48*b*. 48*c*, 48*d* and 48*e* (examples of engaging portion) that engage with the housing 46. The mask member 69 has a shape that blocks visibility of at least a part of the engaging ribs 48*a*, 48*b*, 48*c*, 48*d* and 48*e*. According to the above configuration, the mask member 69 blocks visibility of the at least a part of the engaging ribs 48*a*, 48*b*, 48*c*, 48*d* and 48*e* of the wheel cover 12, and thus it is possible to prevent the user from visually checking a state of the engaging ribs 48*a*, 48*b*, 48*c*, 48*d* and 48*e* to disengage the engagement between the wheel cover 12 and the housing 46. Removal of the wheel cover 12 by the user can be prevented with the simple configuration.

In one or more embodiments, the portion of wheel cover 12 that engages with the housing 46 includes the engaging ribs 48*a*, 48*b*, 48*c*, 48*d* and 48*e*. The bearing box 10, which is a part of the housing 46, includes the flange 58 (an example of engaging wall) that engages with the engaging ribs 48*a*, 48*b*, 48*c*, 48*d* and 48*e*. The flange 58 includes the notches 58*a*, 58*b*, 58*c*, 58*d* and 58*e* through which the engaging ribs 48*a*, 48*b*, 48*c*, 48*d* and 48*e* pass when the wheel cover 12 is attached to the housing 46. According to the above configuration, the engagement between the flange 58 and the engaging ribs 48*a*, 48*b*, 48*c*. 48*d* and 48*e* is disengaged when the engaging ribs 48*a*. 48*b*. 48*c*. 48*d* and 48*e* are aligned with the notches 58*a*, 58*b*, 58*c*, 58*d* and 58*e*. However, since the mask member 69 blocks visibility of the engaging ribs 48*a*. 48*b*. 48*c*. 48*d* and 48*e*, it is possible to prevent the user from aligning the engaging ribs 48*a*, 48*b*. 48*c*. 48*d* and 48*e* with the notches 58*a*, 58*b*. 58*c*. 58*d* and 58*e* to remove the wheel cover 12 from the housing 46. Removal of the wheel cover 12 by the user can be prevented with the simple configuration.

In one or more embodiments, the mask member 69 includes the mask plate 68 shielding the notches 58*a*, 58*b*. 58*c*, 58*d* and 58*e*, and the retainer 70 fixing the mask plate 68 to the housing 46. According to the above configuration, the user cannot visually check the engaging ribs 48*a*. 48*b*, 48*c*, 48*d* and 48*e* from outside through the notches 58*a*, 58*b*, 58*c*, 58*d* and 58*e*, and thus it is possible to prevent the user from aligning the engaging ribs 48*a*, 48*b*, 48*c*, 48*d* and 48*e* with the notches 58*a*, 58*b*, 58*c*, 58*d* and 58*e* to remove the wheel cover 12 from the housing 46. Further, according to the above configuration, the mask plate 68 fixed to the housing 46 shields the notches 58*a*. 58*b*, 58*c*, 58*d* and 58*e* of the flange 58. Therefore, even if the engaging ribs 48*a*, 48*b*. 48*c*, 48*d* and 48*e* are aligned with the notches 58*a*, 58*b*, 58*c*. 58*d* and 58*e*, removal of the wheel cover 12 can be prohibited by the mask plate 68 engaging with the engaging ribs 48*a*, 48*b*, 48*c*. 48*d* and 48*e*. Removal of the wheel cover by the user can be prevented with the simple configuration.

In one or more embodiments, the retainer 70 is screwed to the housing 46. The retainer 70 has a shape that allows rotation of the retainer 70 in a direction along which the retainer 70 is attached to the housing 46 from outside of the housing 46 and prohibits rotation of the retainer 70 in a direction along which the retainer 70 is removed from the housing 46 from the outside of the housing 46. According to the above configuration, the mask plate 68 is fixed to the housing 46 by the retainer 70 and the retainer 70 has the shape that does not allow the retainer 70 to be removed from the housing 46 from outside. Due to this, it is possible to prevent the user from removing the mask plate 68 and the retainer 70 to remove the wheel cover 12 from the housing 46.

In one or more embodiments, the mask plate 68 and the retainer 70 are separate parts. According to the above configuration, each of the mask plate 68 and the retainer 70 can be formed in a simple shape that is easily manufactured.

In one or more embodiments, the grinder 2 (an example of electric power tool) comprises the motor 14, the bevel gears 40 (an example of power transmission mechanism) connected to the motor 14, the housing 46 that houses the motor 14 and the bevel gears 40, the spindle 38 (an example of tool holder) connected to the bevel gears 40, the wheel cover 12 (an example of cover) covering at least a part of the spindle 38, and the mask member 69 (an example of stopper member) prohibiting removal of the wheel cover 12. The mask member 69 is screwed to the housing 46. The mask member 69 has a shape that allows rotation of the mask member 69 in a direction along which the mask member 69 is attached to the housing 46 from outside of the housing 46 and prohibits rotation of the mask member 69 in a direction along which the mask member 69 is removed from the housing 46 from the outside of the housing 46. According to the above configuration, the mask member 69 can prevent the user from removing the wheel cover 12 from the housing 46. Further, according to the above configuration, it is possible to prevent the user from removing the mask member 69 to remove the wheel cover 12 from the housing 46. Removal of the wheel cover 12 by the user can be prevented with the simple configuration.

Second Embodiment

A grinder 102 of this embodiment includes a similar configuration to that of the grinder 2 of the first embodiment. Hereinbelow, only differences from the grinder 2 of the first embodiment will be described in detail.

Figure 18:
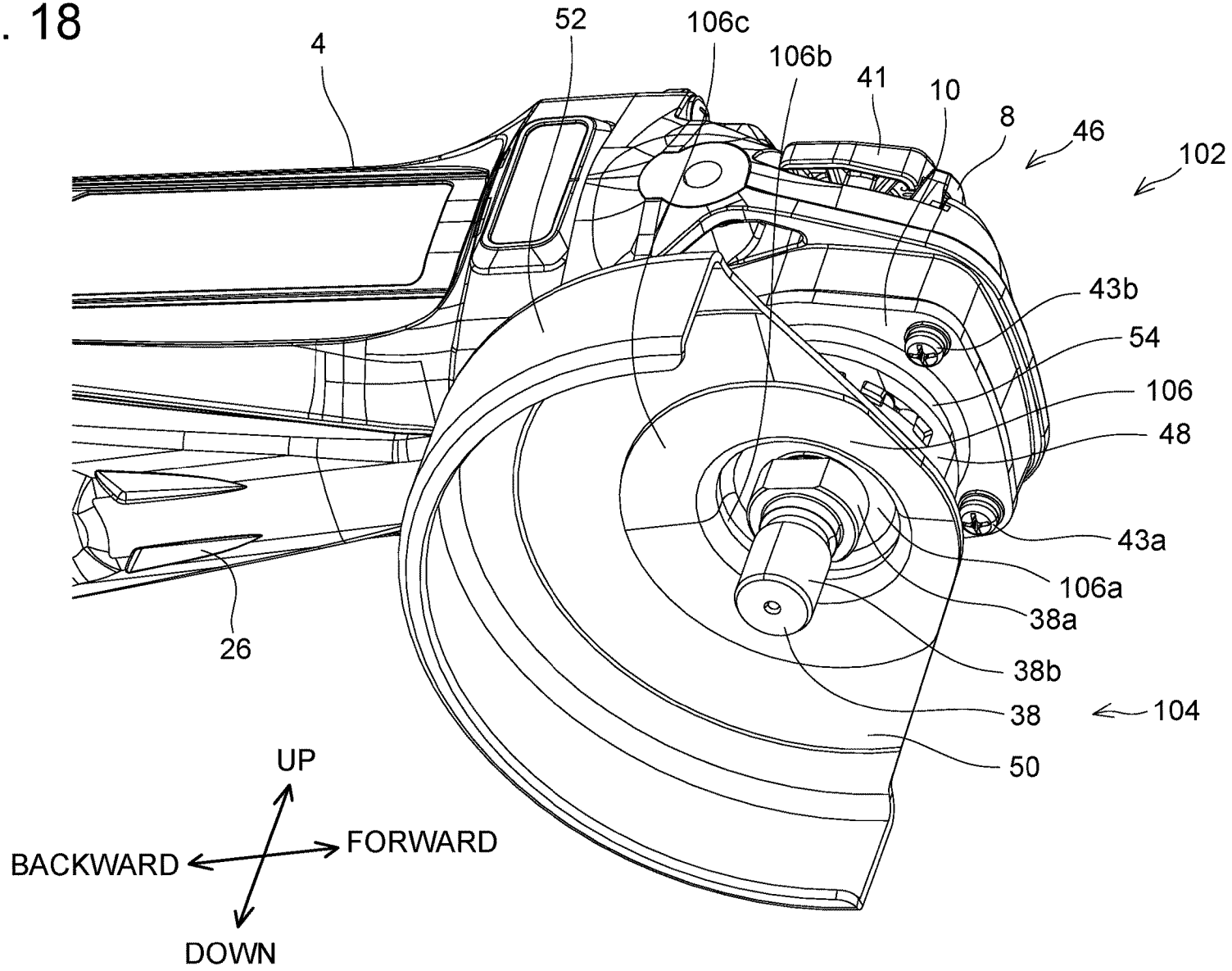
FIG. 18 is a perspective view showing a front part of a grinder 102 according to a second embodiment from lower front right side.

As shown in FIG. 18, the grinder 102 of the present embodiment includes a wheel cover 104, instead of the wheel cover 12 of the first embodiment.

Figure 19:
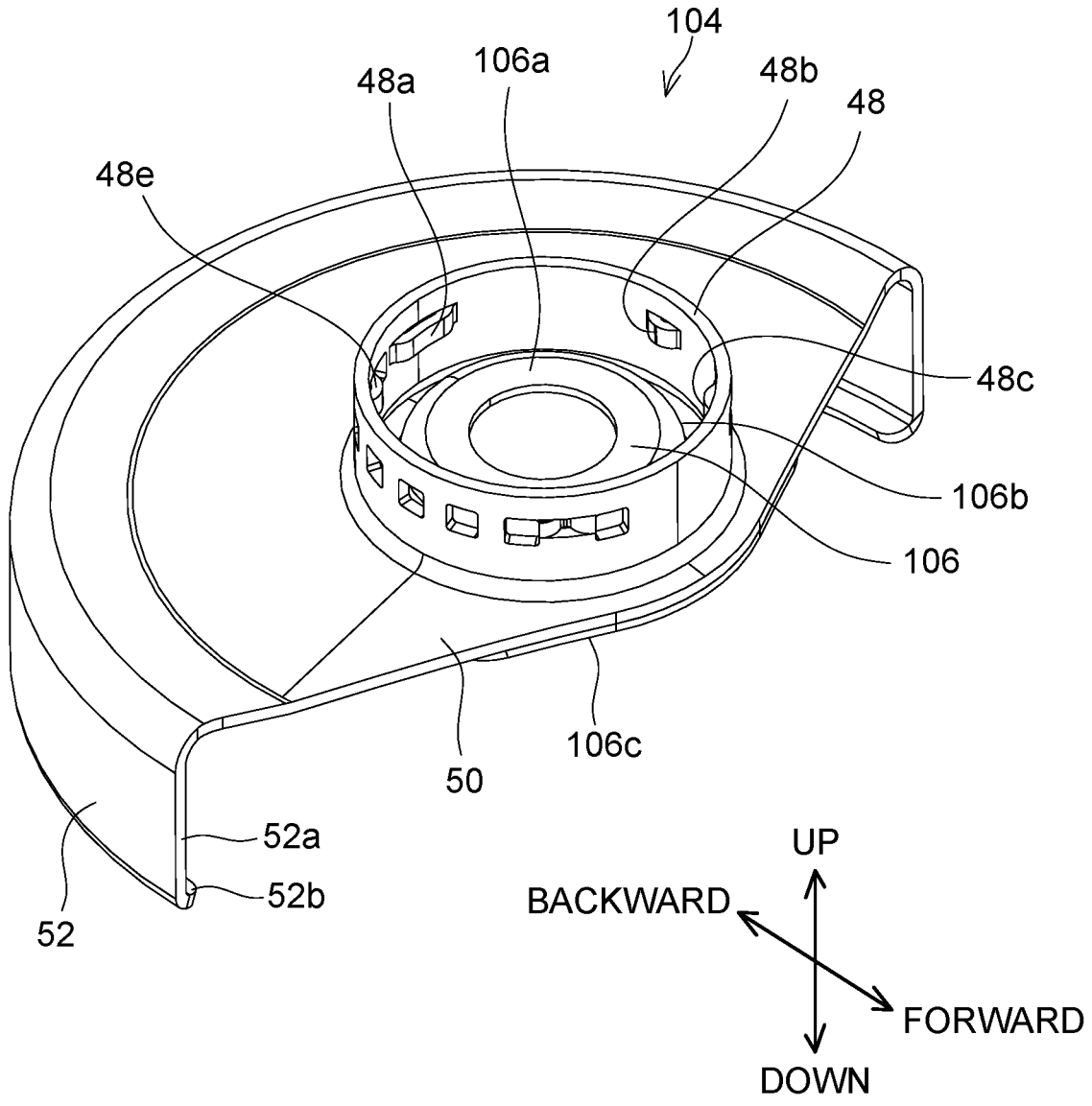
FIG. 19 is a perspective view of a wheel cover 104 of the grinder 102 according to the second embodiment.

As shown in FIG. 19, the wheel cover 104 of the present embodiment includes the band portion 48, the upper surface portion 50 and the side surface portion 52, as in the wheel cover 12 of the first embodiment. The wheel cover 104 of the present embodiment further includes a mask portion 106. The mask portion 106 includes a ring portion 106*a* that has a broad ring shape, a cylinder portion 106*b* that bends downward from an outer end portion of the ring portion 106*a* and has a substantially cylindrical shape extending in the up-down direction, and a circular truncated cone portion 106*c* that expands from a lower end of the cylinder portion 106*b* and has a shape of substantially circular truncated cone. The mask portion 106 is fixed by welding an upper surface of the circular truncated cone portion 106*c* to a lower surface of the upper surface portion 50 in a state where the ring portion 106*a* and the cylinder portion 106*b* are inserted in the band portion 48.

Figure 20:
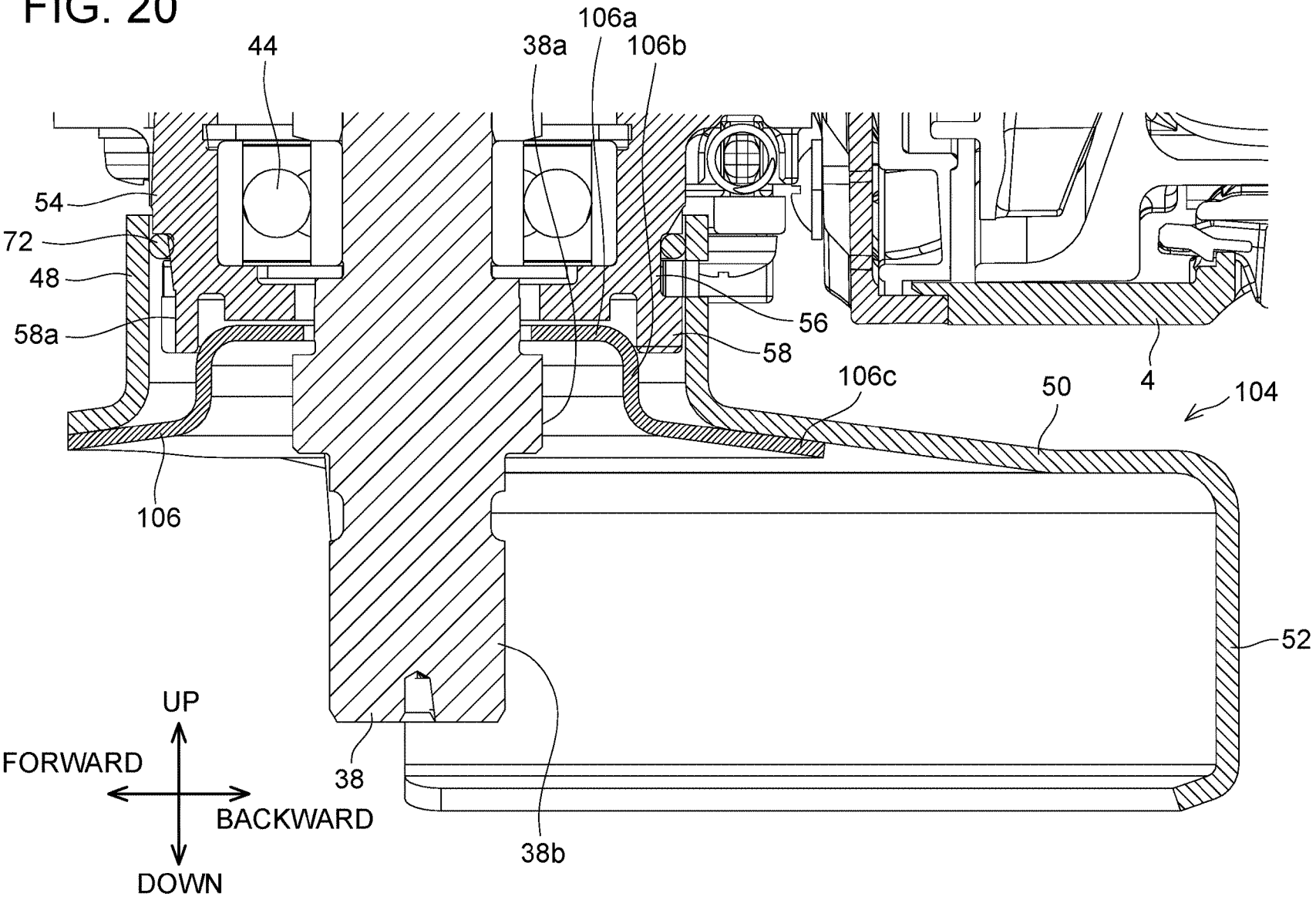
FIG. 20 is a cross sectional view of a portion to which the wheel cover 104 of the grinder 102 according to the second embodiment is attached.

As shown in FIG. 20, in a state where the wheel cover 104 is attached to the bearing box 10, the circular truncated cone portion 106*c* does not allow the notches 58*a*, 58*b*, 58*c*, 58*d* and 58*e* of the flange 58 and the engaging ribs 48*a*, 48*b*, 48*c*, 48*d* and 48*e* of the wheel cover 104 to be visually checked from outside. Due to this, it is possible to prevent the user from aligning the wheel cover 104 to the removable position to remove the wheel cover 104 from the bearing box 10. Further, an inner diameter of the ring portion 106*a* of the wheel cover 104 is smaller than an outer diameter of the projection 38*a* of the spindle 38. Due to this, in the state where the wheel cover 104 is attached to the bearing box 10, the ring portion 106*a* engages with the projection 38*a*. Thus, even if the wheel cover 104 is aligned to the removable position and the engaging ribs 48*a*. 48*b*. 48*c*. 48*d* and 48*e* of the wheel cover 104 are aligned with the notches 58*a*, 58*b*, 58*c*, 58*d* and 58*e* of the flange 58, the wheel cover 104 is prohibited from sliding downward with respect to the bearing box 10 because the ring portion 106*a* engages with the projection 38*a*. Therefore, it is possible to prevent the user from removing the wheel cover 104 from the bearing box 10. In the bearing box 10 of the present embodiment, the cover mounting portion 54 is not provided with the mounting surface 58*f* nor the internal thread 58*g*. The lower surface of the cover mounting portion 54 has a shape that does not interface with the mask portion 106 of the wheel cover 104.

Figure 21:
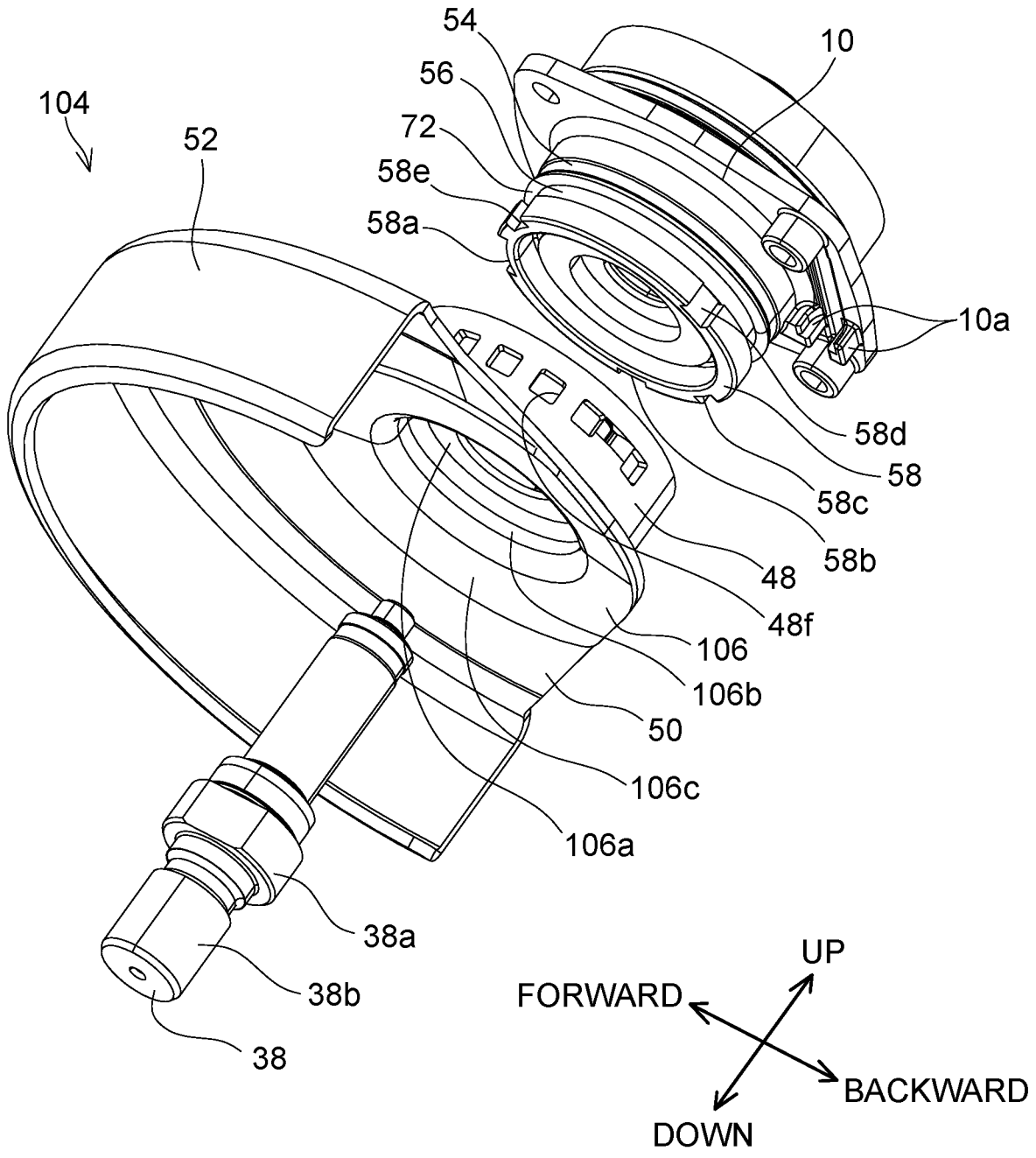
FIG. 21 is a perspective view showing a state before the wheel cover 104 and a spindle 38 are attached to the bearing box 10 of the grinder 102 according to the second embodiment from lower rear left side.

As shown in FIG. 21, when the wheel cover 104 is to be attached to the bearing box 10, the wheel cover 104 is attached to the cover mounting portion 54 of the bearing box 10 to which the spindle 38 and the lock mechanism 60 are not yet attached in a state where the O-ring 72 is attached to the cover mounting portion 54. In the state where the engaging ribs 48*a*, 48*b*, 48*c*, 48*d* and 48*e* of the wheel cover 104 are aligned with the notches 58*a*, 58*b*, 58*c*, 58*d* and 58*e* of the cover mounting portion 54, the wheel cover 104 is slid upward with respect to the bearing box 10 such that the cover mounting portion 54 is inserted into the band portion 48. Due to this, the wheel cover 104 is attached to the cover mounting portion 54. After this, the spindle 38 is inserted into the bearing box 10 through the ring portion 106*a* from below the wheel cover 104. Due to this, the spindle 38 is attached to the bearing box 10. After this, the lock mechanism 60 is attached to the bearing box 10 and the bearing box 10 is attached to the gear housing 8, which completes the grinder 102 to which the wheel cover 104 is attached. When the wheel cover 104 is to be removed from the bearing box 10, the bearing box 10 to which the wheel cover 104 is attached is removed from the gear housing 8. Then, the spindle 38 is removed from the bearing box 10, as a result of which the wheel cover 104 can be removed from the bearing box 10. With such a configuration, maintainability can be ensured.

Figure 22:
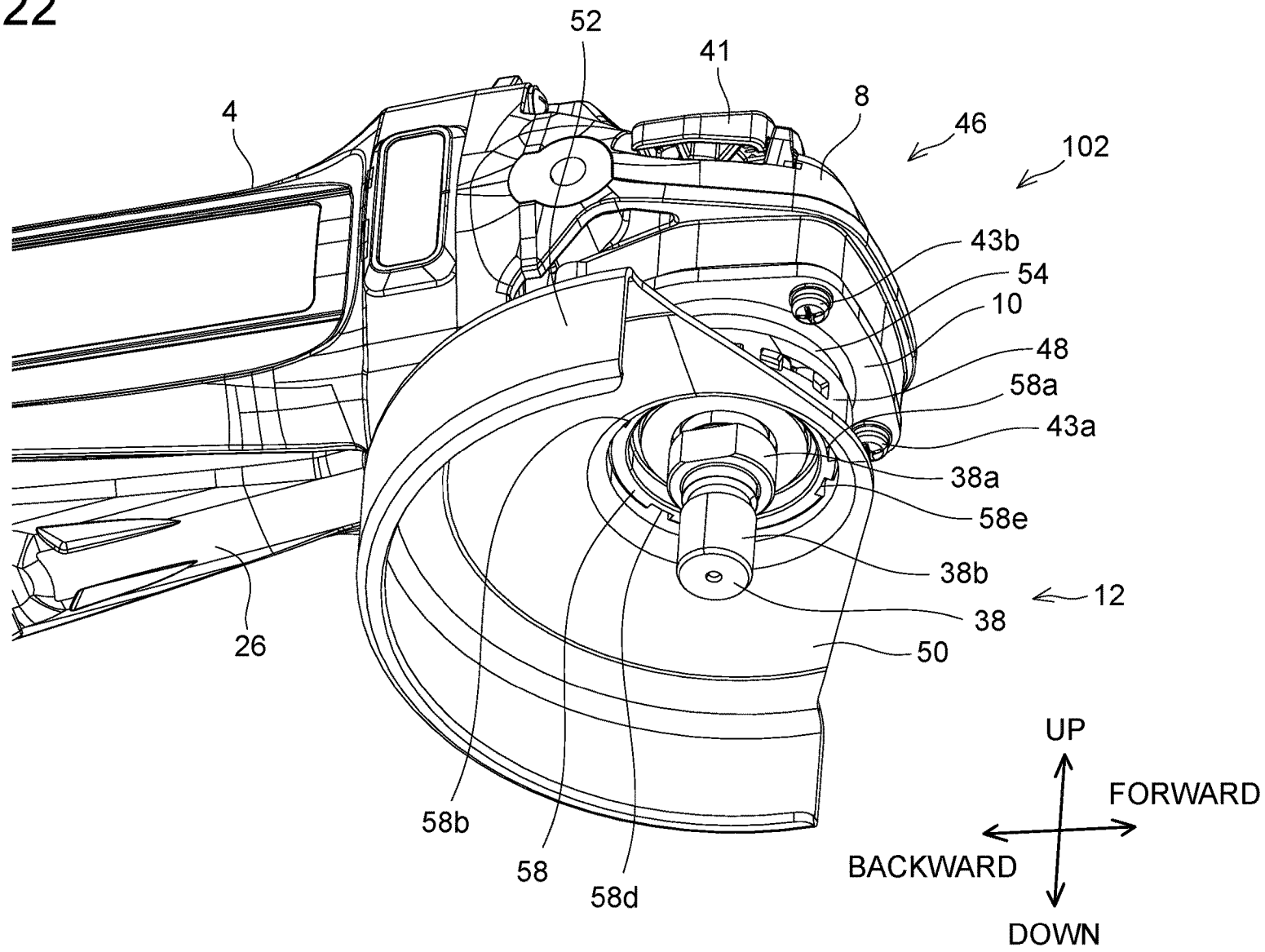
FIG. 22 is a perspective view showing the front part of the grinder 102 according to the second embodiment from lower front right side, and shows a state where the wheel cover 12 is attached instead of the wheel cover 104.

As shown in FIG. 22, the grinder 102 of the present embodiment can employ a configuration where the wheel cover 12 of the first embodiment is attached, instead of the wheel cover 104. In the configuration shown in FIG. 22, the notches 58*a*, 58*b*, 58*c*, 58*d* and 58*e* of the flange 58 and the engaging ribs 48*a*. 48*b*, 48*c*, 48*d* and 48*e* of the wheel cover 12 can be visibly checked from outside. Further, the user can remove the wheel cover 12 from the bearing box 10 by sliding the wheel cover 12 downward with respect to the bearing box 10 in the state where the wheel cover 12 is aligned to the removable position.

As described above, in one or more embodiments, the grinder 102 (an example of electric power tool) comprises the motor 14, the bevel gears 40 (an example of power transmission mechanism) connected to the motor 14, the housing 46 that houses the motor 14 and the bevel gears 40, the spindle 38 (an example of tool holder) projecting from the housing 46, the wheel cover 104 (an example of cover) covering at least a part of the grinding wheel GW (an example of tool) attached to the spindle 38 and the mask portion 106 (an example of mask member) which is a part of the wheel cover 104. The wheel cover 104 includes the engaging ribs 48*a*, 48*b*, 48*c*, 48*d* and 48*e* (examples of engaging portion) that engage with the housing 46. The mask portion 106 has a shape that blocks visibility of at least a part of the engaging ribs 48*a*, 48*b*, 48*c*, 48*d* and 48*e*. According to the above configuration, the mask portion 106 blocks visibility of the at least a part of the engaging ribs 48*a*, 48*b*, 48*c*, 48*d* and 48*e*, it is possible to prevent the user from visibly checking a state of the engaging ribs 48*a*, 48*b*, 48*c*, 48*d* and 48*e* to disengage the engagement between the wheel cover 104 and the housing 46. Removal of the wheel cover 104 by the user can be prevented with the simple configuration.

In one or more embodiments, the portion of the wheel cover 104 that engages with the housing 46 includes the engaging ribs 48*a*. 48*b*, 48*c*, 48*d* and 48*e*. The housing 46 includes the flange 58 (an example of engaging wall) that engages with the engaging ribs 48*a*, 48*b*, 48*c*, 48*d* and 48*e*. The flange 58 includes the notches 58*a*, 58*b*, 58*c*, 58*d* and 58*e* through which the engaging ribs 48*a*, 48*b*, 48*c*, 48*d* and 48*e* pass when the wheel cover 104 is attached to the housing 46. According to the above configuration, when the engaging ribs 48*a*, 48*b*, 48*c*, 48*d* and 48*e* are aligned with the notches 58*a*, 58*b*, 58*c*, 58*d* and 58*e*, the engagement between the flange 58 and the engaging ribs 48*a*, 48*b*, 48*c*, 48*d* and 48*e* is disengaged. However, since the mask portion 106 blocks visibility of the engaging ribs 48*a*, 48*b*, 48*c*, 48*d* and 48*e*, it is possible to prevent the user from aligning the engaging ribs 48*a*, 48*b*, 48*c*, 48*d* and 48*e* with the notches 58*a*. 58*b*, 58*c*. 58*d* and 58*e* to remove the wheel cover 104 from the housing 46. Removal of the wheel cover 104 by the user can be prevented with the simple configuration.

In one or more embodiments, the mask portion 106 is fixed to the wheel cover 104. According to the above configuration, removal of the wheel cover 104 by the user can be prevented without making a great modification to the existing housing 46 of the grinder 102.

In one or more embodiments, the mask portion 106 is engaged with the spindle 38. According to the above configuration, even if the engagement between the housing 46 and the engaging ribs 48*a*, 48*b*, 48*c*, 48*d* and 48*e* of the wheel cover 104 is disengaged, removal of the wheel cover 104 can be prevented by the mask portion 106 fixed to the wheel cover 104 engaging with the spindle 38. Removal of the wheel cover 104 by the user can be prevented with the simple configuration.

In the above embodiments, the cases where an electric power tool is the grinder 2, 102; a power transmission mechanism is the bevel gears 40; a tool holder is the spindle 38; a tool is the grinding wheel GW; and a cover is the wheel cover 12, 104 have been described as examples. However, the electric power tool may be an electric power tool of another type, the power transmission mechanism may be a power transmission mechanism of another type, the tool holder may be a tool holder of another type, the tool may be a tool of another type, and the cover may be a cover of another type.

What is claimed is:

1. An electric power tool comprising:

a motor;

a power transmission mechanism connected to the motor;

a housing that houses the motor and the power transmission mechanism;

a tool holder projecting from the housing;

a cover configured to cover at least a part of a tool attached to the tool holder when the cover is attached to the housing; and a mask member, wherein:

the cover includes an engaging portion that is configured to engage the housing when the cover is attached to the housing;

the mask member has a shape that blocks visibility of at least a part of the engaging portion when the mask member and the cover are attached to the housing;

the engaging portion includes an engaging rib;

the housing includes an engaging wall that is configured to engage the engaging rib when the cover is attached to the housing;

the engaging wall includes a notch that is configured such that the engaging rib passes through the notch when the cover is attached to and detached from the housing;

the mask member includes:

a mask plate that is configured to shield the notch when the mask member and the cover are attached to the housing; and a retainer configured to fix the mask plate to the housing;

the retainer and the housing are configured such that the retainer is attached to the housing by rotating the retainer circumferentially with respect to the housing; and the retainer has an external structural feature that is configured (i) to be used by a user of the electric power tool to rotate the retainer in a direction along which the retainer is attached to the housing from outside of the housing and (ii) such that the external structural feature cannot be used by the user to rotate the retainer in a direction along which the retainer is removed from the housing from the outside of the housing.

2. The electric power tool according to claim 1, wherein the mask plate and the retainer are separate parts.

3. The electric power tool according to claim 1, wherein the mask member is configured to be fixed to the cover.

4. The electric power tool according to claim 3, wherein the mask member is configured to engage the tool holder.

5. The electric power tool according to claim 1, wherein:

one of the retainer and a cover mounting portion of the housing includes an exterior thread;

another of the retainer and the cover mounting portion includes an internal thread;

the exterior thread and the internal thread are configured to mate; and the retainer is attached to and detached from the cover mounting portion by rotation of the exterior thread relative to the internal thread.

6. The electric power tool according to claim 1, wherein the retainer is rotated around a longitudinal axis of the tool holder to attach and detach the retainer.

7. The electric power tool according to claim 1, wherein:
the retainer and the housing are attachable via a screw thread attachment.

8. The electric power tool according to claim 1, wherein:
the housing includes a first housing and a bearing box;
the first housing houses the motor and the power transmission mechanism;
the bearing box houses a spindle wherein the spindle is rotatable within the bearing box;
the bearing box is removably attached to the first housing;
the bearing box includes the engaging wall;
the tool holder includes the spindle;
the mask member is configured to be removably attachable to the bearing box; and the bearing box, the first housing and the mask member are configured such that the bearing box must be detached from the first housing to detach the mask member from the bearing box.

9. The electric power tool according to claim 1, wherein the cover, the retainer and the housing are configured such that, when the retainer is attached to the housing, the cover can be rotated around an axis of rotation but the cover cannot move axially along the axis of rotation.

10. The electric power tool according to claim 1, further comprising
a lock mechanism configured to move between a lock position and an unlock position, wherein the lock mechanism, the cover, the retainer and the housing are configured such that
under a state where the lock mechanism is at the lock position, rotation of the cover relative to the housing is inhibited and under a state where the lock mechanism is at the unlock position, rotation of the cover relative to the housing is allowed,
under a state where the retainer is attached to the housing and the lock mechanism is at the unlock position, rotation of the cover relative to the housing is allowed and rotation of the retainer relative to the housing is allowed, and
under a state where the retainer is attached to the housing and the lock mechanism is at the lock position, rotation of the cover relative to the housing is inhibited and rotation of the retainer relative to the housing is allowed.

11. An electric power tool comprising:
a motor;
a power transmission mechanism connected to the motor;
a housing that houses the motor and the power transmission mechanism;
a tool holder connected to the power transmission mechanism;
a cover configured to cover at least a part of the tool holder when the cover is attached to the housing; and
a stopper member configured to prohibit removal of the cover from the electric power tool when the cover is attached to the housing;
wherein
the stopper member and the housing are configured such that the stopper member is attached to the housing by circumferentially rotating the stopper member with respect to the housing; and
the stopper member has an external structural feature that is configured (i) to be used by a user of the electric power tool to rotate the stopper member in a direction along which the stopper member is attached to the housing from outside of the housing and (ii) such that the structural feature cannot be used by the user to rotate the stopper member in a direction along which the stopper member is removed from the housing from the outside of the housing.

12. The electric power tool according to claim 11, wherein:
one of the housing and the stopper member includes an exterior thread;
another of the housing and the stopper member includes an internal thread;
the exterior thread and the internal thread are configured to mate; and
the stopper member is configured to be attached to and detached from the housing by rotation of the exterior thread relative to the internal thread.

13. An electric power tool comprising:
a motor;
a power transmission mechanism connected to the motor;
a housing that houses the motor and the power transmission mechanism;
a tool holder projecting from the housing;
a tool attached to the tool holder;
a cover configured to cover at least a part of the tool;
a stopper member configured to inhibit removal of the cover from the housing without prohibiting rotation of the cover relative to the housing; and
a lock mechanism configured to move between a lock position and an unlock position,
wherein the lock mechanism, the cover and the housing are configured such that, under a state where the lock mechanism is at the lock position, rotation of the cover relative to the housing is inhibited, and under a state where the lock mechanism is at the unlock position, rotation of the cover relative to the housing is allowed.

14. The electric power tool according to claim 13, wherein the cover, the stopper member and the housing are configured such that, when the stopper member is attached to the housing, the cover can be rotated around an axis of rotation but the cover cannot move axially along the axis of rotation.

15. The electric power tool according to claim 14, wherein the housing comprises a cover mounting portion, the cover mounting portion includes a guide groove defined along a circumferential direction,
the cover comprises a band portion configured to be attached to the cover mounting portion;
the band portion includes a rib configured to slide in the guide groove in the circumferential direction, and
the stopper member, the housing, the cover, the rib and the guide groove are configured such that, when the stopper member is attached to the housing and the rib is disposed in the guide groove, the cover can be rotated around the axis of rotation but the cover cannot move axially along the axis of rotation.

16. The electric power tool according to claim 15, wherein the cover mounting portion further comprises a notch extending in an axial direction and communicating with the guide groove,
the rib is configured to pass through the notch when the cover is being attached to or detached from the housing,
the stopper member comprises a ring portion and an extending portion extending from the ring portion toward the guide groove in the axial direction and corresponding to the notch,
wherein the stopper member, the housing, the cover, the rib and the guide groove are configured such that, when the stopper member is attached to the housing and the rib is in the guide groove, the cover can be rotated around the axis of rotation but the cover cannot move axially along the axis of rotation by the extending portion being in the notch.

17. The electric power tool according to claim 13, wherein the stopper member and the housing are configured such that the stopper member is attached to the housing by circumferentially rotating the stopper member with respect to the housing.

18. The electric power tool according to claim 17, wherein the stopper member, the housing, the lock mechanism and the cover are configured such that under a state where the stopper member is attached to the housing and the lock mechanism is at the unlock position, rotation of the cover relative to the housing is allowed and rotation of the stopper member relative to the housing is allowed, and under a state where the stopper member is attached to the housing and the lock mechanism is at the lock position, rotation of the cover relative to the housing is inhibited and rotation of the stopper member relative to the housing is allowed.

19. The electric power tool according to claim 17, wherein the stopper member has an external structural feature that is configured (i) to be used by a user of the electric power tool to rotate the stopper member in a direction along which the stopper member is attached to the housing from outside of the housing and (ii) such that the structural feature cannot be used by the user to rotate the stopper member in a direction along which the stopper member is removed from the housing from the outside of the housing.

* * * * *